US007677693B2

(12) United States Patent
Jeon et al.

(10) Patent No.: US 7,677,693 B2
(45) Date of Patent: Mar. 16, 2010

(54) LINE PRINTING TYPE INKJET IMAGE FORMING APPARATUS AND METHOD OF ENHANCING PRINTED IMAGE QUALITY

(75) Inventors: Seong-nam Jeon, Suwon-si (KR); Jung-hwan Kim, Seoul (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 794 days.

(21) Appl. No.: 11/444,472

(22) Filed: Jun. 1, 2006

(65) Prior Publication Data

US 2006/0274095 A1 Dec. 7, 2006

(30) Foreign Application Priority Data

Jun. 1, 2005 (KR) ..... 10-2005-0046741

(51) Int. Cl.
*B41J 2/15* (2006.01)

(52) U.S. Cl. ..... 347/41; 347/15

(58) Field of Classification Search ..... 347/12, 347/40, 15, 41, 43, 14
See application file for complete search history.

(56) References Cited

U.S. PATENT DOCUMENTS 4,920,355 A * 4/1990 Katerberg ..... 347/41
6,497,467 B2 12/2002 Suwa et al.
6,644,783 B1 * 11/2003 Tsuruoka ..... 347/41

FOREIGN PATENT DOCUMENTS

| | | |
|---|---|---|
| JP | 8-118726 | 5/1996 |
| JP | 11-278735 | 10/1999 |
| JP | 2000-127372 | 5/2000 |
| JP | 2001-30476 | 2/2001 |
| JP | 2001-232781 | 8/2001 |
| JP | 2001-328245 | 11/2001 |
| JP | 2004-167984 | 6/2004 |

* cited by examiner

*Primary Examiner*—Lamson D Nguyen
(74) *Attorney, Agent, or Firm*—Stanzione & Kim, LLP

(57) ABSTRACT

A line printing type inkjet image forming apparatus and a method of enhancing printed image quality. The inkjet image forming apparatus includes a printhead having one or more subheads having nozzles and a length corresponding to a width of a print medium, a driving unit to drive the nozzles, a first feeding path, a second feeding path through which the print medium is guided to be again fed along the first feeding path, a path conversion guide unit being disposed in a position where the first and second feeding paths intersect to guide the print medium to be discharged or fed along the second feeding path, a print medium feeding unit, and a controller to synchronize operations of the driving unit, the path conversion guide unit, and the print medium feeding unit, wherein the controller drives the nozzles and the nozzles divided in groups in the same direction time-divisionally.

27 Claims, 18 Drawing Sheets

LINE PRINTING TYPE INKJET IMAGE FORMING APPARATUS AND METHOD OF ENHANCING PRINTED IMAGE QUALITY

CROSS-REFERENCE TO RELATED APPLICATIONS

This application claims the benefit under 35 U.S.C. §119 of Korean Patent Application No. 2005-46741, filed on Jun. 1, 2005, in the Korean Intellectual Property Office, the disclosure of which is incorporated herein in its entirety by reference.

BACKGROUND OF THE INVENTION

1. Field of the Invention

The present general inventive concept relates to an inkjet image forming apparatus, and more particularly, to a line printing type inkjet image forming apparatus which prevents deviations of ink dots from original locations during time-division driving.

2. Description of the Related Art

In general, inkjet image forming apparatuses form ink images on a print medium by ejecting ink from a printhead that reciprocates in a widthwise direction that is perpendicular to a feeding direction of the print medium while being spaced apart from a top side of the print medium by a predetermined gap, thereby forming an image. Such an inkjet image forming apparatus for printing the image by ejecting ink onto the print medium while the printhead reciprocates in the direction perpendicular to the feeding direction of the print medium is referred to as a shuttle type inkjet image forming apparatus. A nozzle unit including a plurality of nozzles ejecting ink is disposed at the printhead of the shuttle type inkjet image forming apparatus.

Recently, to achieve a high-speed printing, a printhead having a fixed nozzle unit with a length corresponding to a width of the print medium has been developed to replace the printhead reciprocating in the widthwise direction of the print medium. An inkjet image forming apparatus having the printhead with the fixed nozzle unit is referred to as a line printing type inkjet image forming apparatus. The printhead of the line printing type inkjet image forming apparatus is fixed and only the print medium is moved. Thus, a unit for driving the line inkjet image forming apparatus is simple and the high-speed printing can be achieved, but when a required resolution is higher than an actual resolution of the printhead, it is difficult to print an image with the required higher resolution.

Japanese Patent Laid-open Publication No. 2001-232781 describes a conventional inkjet image forming apparatus. FIG. 1 illustrates ink dots ejected on a print medium using a conventional inkjet image forming apparatus. FIG. 2 illustrates an example of ink dots ejected on another print medium using the conventional image forming apparatus. FIG. 3 illustrates another example of ink dots ejected on another print medium using the conventional image forming apparatus. In addition, FIG. 4 is an enlarged view of a portion of print regions of the printing medium of FIGS. 2 and 3.

A printhead 20 having a plurality of nozzles N1 to NN and extending along a width of the print medium P in a direction that is perpendicular to a print medium-feeding direction (X-direction) is illustrated in FIG. 1. When the plurality of nozzles N1 to NN are sequentially driven, a deviation degree W that corresponds to a distance from a dot DD1 to a dot DDN in the print medium-feeding direction is generated on the print medium P. Here, the deviation degree W is a difference in the print medium-feeding direction between positions of the dot DD1 ejected from a first nozzle N1 and the dot DDN ejected from an N-th nozzle NN. As the deviation degree W increases, ink dots are not deposited (or ejected) at correct positions and as ink dots deviate further from the correct positions, an image quality is lowered. To enhance resolution in the medium-feeding direction of the print medium P, the print medium P should be slowly fed and printed. The deviation degree W can be reduced using the following methods: as illustrated in FIG. 2, ink may be ejected by dividing a plurality of head chips 21 into groups so that the groups are placed in a reverse order, or as illustrated in FIG. 3, ink may be ejected by disposing the plurality of head chips 21 alternately so that the head chips 21 are placed in the reverse order. However, when a time-division driving is performed in the reverse order, as illustrated in FIG. 4, the deviation degree W can be reduced, but the ink dots are not uniformly ejected. For example, two ink dots are deposited in a predetermined region 10 while ink dots are not deposited in another region 30. That is, ink dots are not uniformly deposited on the entire region of the printing medium P. Thus, a difference in an optical density occurs between the predetermined region 10 where ink dots are overlappingly deposited while the region 30 where ink dots are not deposited thereby lowering the printed image quality. This is a big problem in the conventional inkjet image forming apparatus that attempts to print high quality images. Accordingly, an inkjet image forming apparatus having an improved structure becomes necessary.

SUMMARY OF THE INVENTION

The present general inventive concept provides an inkjet image forming apparatus and a printing method having an improved structure to minimize a deviation degree between ink dots generated by time-division driving (i.e., a difference in locations of dots ejected from a first nozzle and dots ejected from the last nozzle), thereby improving a printed image quality.

The present general inventive concept also provides an inkjet image forming apparatus and a printing method to enhance the printed image quality by preventing ink dots ejected from adjacent nozzles from overlapping.

The present general inventive concept also provides an inkjet image forming apparatus and a printing method to print with higher resolution than an actual resolution of a printhead.

Additional aspects and advantages of the present general inventive concept will be set forth in part in the description which follows and, in part, will be obvious from the description, or may be learned by practice of the general inventive concept.

The foregoing and/or other aspects of the present general inventive concept may be achieved by providing an inkjet image forming apparatus including a printhead having one or more subheads having one or more groups each including a plurality of nozzles and having a printhead length corresponding to a width of a print medium, a driving unit to drive the plurality of nozzles of the one or more subheads to print an image, a first feeding path through which the print medium is guided to be fed to the printhead in a feeding direction, a second feeding path which is connected to the first feeding path and through which the print medium on which the image has been printed is guided to be again fed along the first feeding path, a path conversion guide unit disposed in a position where the first and second feeding paths intersect to guide the print medium to be discharged or fed along the second feeding path, a print medium feeding unit installed on the first and second feeding paths to feed the print medium along the first and second feeding paths, and a controller to synchronize operations of the driving unit, the path conversion guide unit, and the print medium feeding unit so that ink ejected from the one or more subheads is deposited on a desired portion of the print medium, and to generate a first control signal to control the driving unit to time-divisionally drive the one or more subheads and the one or more groups, wherein the controller drives time-divisionally the plurality of nozzles and the nozzles of the one or more groups in a same direction.

The inkjet image forming apparatus may further include a printing environment information unit to store information about a predetermined printing environment when image data is printed to form the image according to the predetermined printing environment, wherein the controller generates a second control signal to drive the path conversion guide unit and the driving unit according to the information about the predetermined printing environment stored in the printing environment information unit.

The controller may generate a second control signal to determine an order for driving the plurality of nozzles of the one or more subhead and the one or more groups so that patterns printed by driving the plurality of nozzles of the one or more subhead subheads and patterns printed by driving the plurality of nozzles of the one or more groups form slanted lines having a same slope.

The controller may generate a third control signal so that the patterns printed by driving the plurality of nozzles of the one or more groups are symmetrical with one another based on the patterns printed by driving the plurality of nozzles of the one or more subhead.

The controller may generate a fourth control signal so that, when the printhead performs a first printing operation, the plurality of nozzles of each of the one or more subheads are time-divisionally driven in the same direction.

The controller may generate a fifth control signal so that, when the print medium is fed along the second feeding path, the plurality of nozzles of the one or more groups are time-divisionally driven in the same direction.

The path conversion guide unit may include a guide main body, a first shaft formed with the guide main body protruding from both end sides of an upper-end portion of the guide main body, a second shaft inserted into the upper-end portion of the guide main body so that an axial center of the second shaft coincides with that of the first shaft, and a support to support the second shaft so that the second shaft is not deviated from the guide main body, and the support being formed with the guide main body at the upper-end portion of the guide main body.

The second shaft may be formed of metal having rigidity with respect to deformation.

The path conversion guide unit may include a plurality of grooves disposed perpendicular to edges formed at a lower-end portion of the guide main body.

The support may include a plurality of first supports to protrude from one side of the upper-end portion of the guide main body to partially surround an outer circumference of the second shaft, and a plurality of second supports to protrude from the other side of the upper-end portion of the guide main body.

The driving unit may be a thermal driving type driving unit.

The driving unit may be a piezoelectric device type driving unit.

The one or more subheads may be disposed in a zigzag pattern in a widthwise direction of the print medium.

The foregoing and/or other aspects of the present general inventive concept may also be achieved by providing an inkjet image forming apparatus including a printhead having a first nozzle row and a second nozzle row respectively including one or more subheads and a length corresponding to a width of a print medium, the one or more subheads each having one or more groups each having a plurality of nozzles arranged in the first nozzle row and the second nozzle row, respectively, a driving unit to drive the plurality of nozzles of the one or more subheads to print an image, a print medium feeding unit to feed the print medium along a predetermined path in a feeding direction, and a controller to synchronize operations of the driving unit and the print medium feeding unit so that ink ejected from the plurality of nozzles of the one or more subheads to be deposited on a desired portion of the print medium and to generate a first control signal so that the driving unit time-divisionally drives the first and second nozzle rows and the first and second nozzle rows, wherein the controller time-divisionally drives the first and second nozzle rows and the one or more groups in a same direction.

The inkjet image forming apparatus may further include a printing environment information unit to store information about a predetermined printing environment when image data is printed according to the predetermined printing environment, wherein the controller generates a second control signal to drive the driving unit according to the information about the predetermined printing environment stored in the printing environment information unit.

The controller may generate a third control signal to time-divisionally drive nozzles of the first nozzle row from a first nozzle to a last nozzle and to time-divisionally drive the nozzles of the one or more groups of the second nozzle row.

The controller may generate a third control signal to determine an order of driving the first nozzle row and the M groups so that patterns printed by driving the first nozzle row and patterns printed by driving the one or more groups form slanted lines having a same slope.

The one or more subheads may be disposed in a zigzag pattern in a widthwise direction of the print medium.

The foregoing and/or other aspects of the present general inventive concept may also be achieved by providing a method of enhancing printed image quality of an inkjet image forming apparatus, the method including inputting data to be printed from a host, comparing an input resolution with an actual resolution of a printhead, feeding a print medium along a first feeding path and time-divisionally driving nozzles of the printhead to print an image on the print medium, feeding the print medium along the first feeding path via a second feeding path if the input resolution is higher than the actual resolution, and time-divisionally driving the nozzles of the printhead divided into one or more groups to print an image on the print medium, wherein an order of the feeding of the print medium and time-divisionally driving of the nozzles of the printhead and an order for the time-divisionally driving of the nozzles of the printhead divided into one or more groups are in the same direction.

First patterns printed by the feeding of the print medium and time-divisionally driving of the nozzles of the printhead and second patterns printed by the time-divisionally driving of the nozzles of the printhead divided into the one or more groups may form slanted lines having a same slope.

The foregoing and/or other aspects of the present general inventive concept may also be achieved by providing an apparatus including a data input unit to input data to be printed from a host, a feeding unit to feed a print medium, a driving unit to time-divisionally drive the printhead, and a controller to compare an input resolution with an actual resolution of a printhead, to control the feeding unit to feed the print medium along a first feeding path, to control the driving unit to time-divisionally drive nozzles of the printhead to print an image on the print medium, to control the feeding unit to feed again the print medium along the first feeding path via a second feeding path if the input resolution is higher than the actual resolution, and to control the driving unit to time-divisionally drive the nozzles of the printhead divided into one or more groups to print the image on the print medium, wherein an order of time-divisionally driving the nozzles of the printhead and an order of the time-divisionally driving of the nozzles the printhead divided into the one or more groups are in a same direction.

The foregoing and/or other aspects of the present general inventive concept may also be achieved by providing an image forming apparatus including a printhead unit including a first subhead having first and second groups having a plurality of first and second nozzles, respectively, and a second subhead having third and fourth groups having a plurality of third and fourth nozzles, respectively, and a controller to control the printhead unit to perform a first printing operation to sequentially eject ink from first and third nozzles in a first direction, and to control the printhead unit to perform a second printing operation to sequentially eject ink from second and fourth nozzles in the second and fourth group in the first direction such that an image is formed through the first and second printing operations.

The foregoing and/or other aspects of the present general inventive concept may also be achieved by providing a method of controlling an inkjet image forming apparatus including a printhead unit having a plurality of nozzles arranged along a width of a print medium, the method including feeding a print medium at least twice under the printhead unit, controlling the printhead unit to perform a first print operation using a first sequence of the plurality of nozzles in a predetermined ejection direction, and controlling the printhead unit to perform a second print operation using a second sequence of the plurality of nozzles in the same predetermined ejection direction.

The foregoing and/or other aspects of the present general inventive concept may also be achieved by providing a computer readable medium containing executable code to control an inkjet image forming apparatus including a printhead unit having a plurality of nozzles extended along a width of a print medium, the method including a first executable code to control the inkjet image forming apparatus to feed a print medium at least twice under the printhead unit, a second executable code to control the printhead unit to perform a first print operation using a first sequence of the plurality of nozzles in a predetermined ejection direction, and a third executable code to control the printhead unit to perform a second print operation using a second sequence of the plurality of nozzles in the same predetermined ejection direction.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
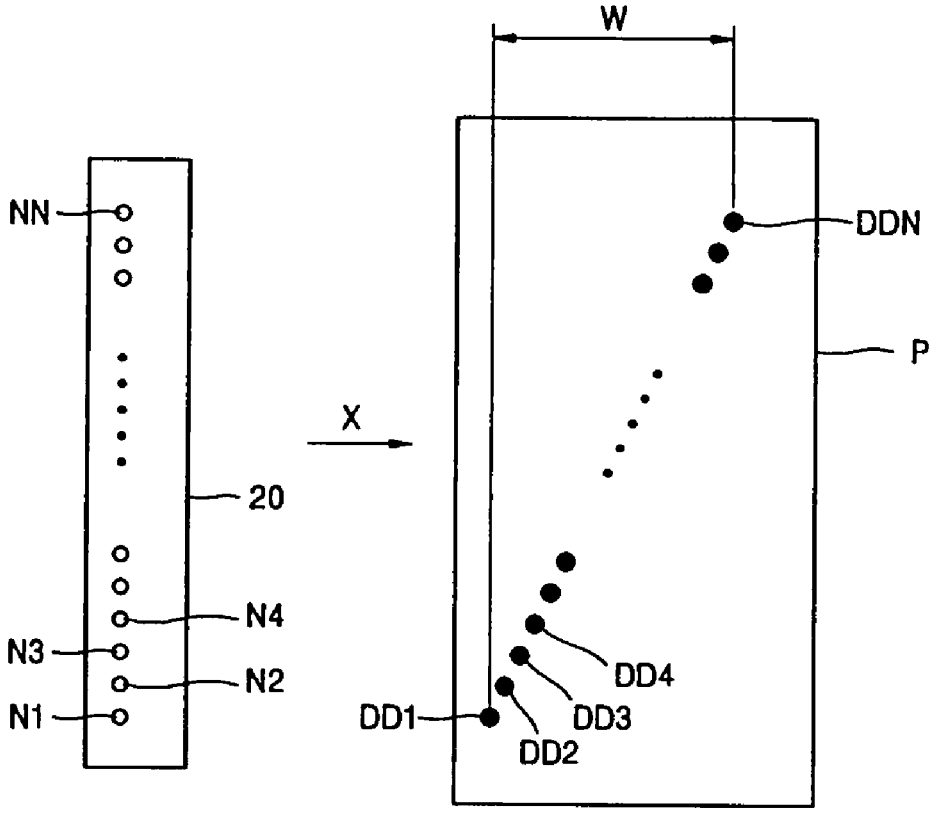
FIG. 1 (PRIOR ART)
FIG. 1 illustrates ink dots deposited on a print medium using a conventional inkjet image forming apparatus.
Figure 2:
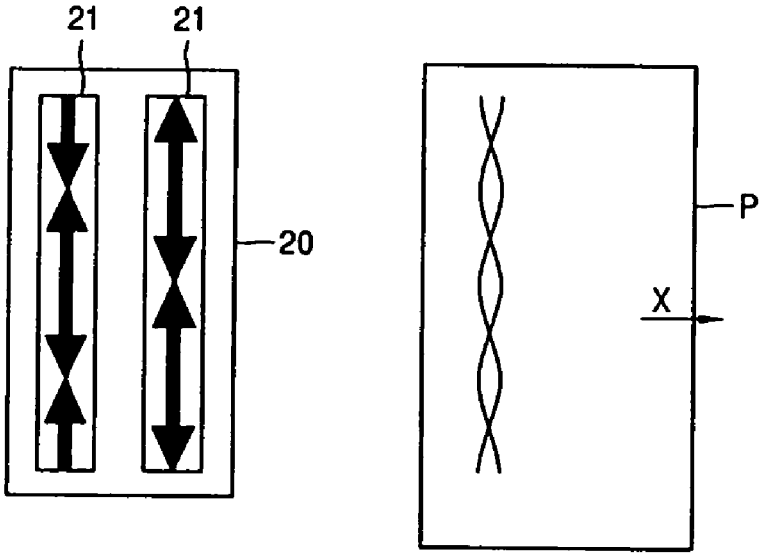
FIG. 2 (PRIOR ART)
FIG. 2 illustrates an example of ink dots deposited on another print medium using the conventional image forming apparatus.
Figure 3:
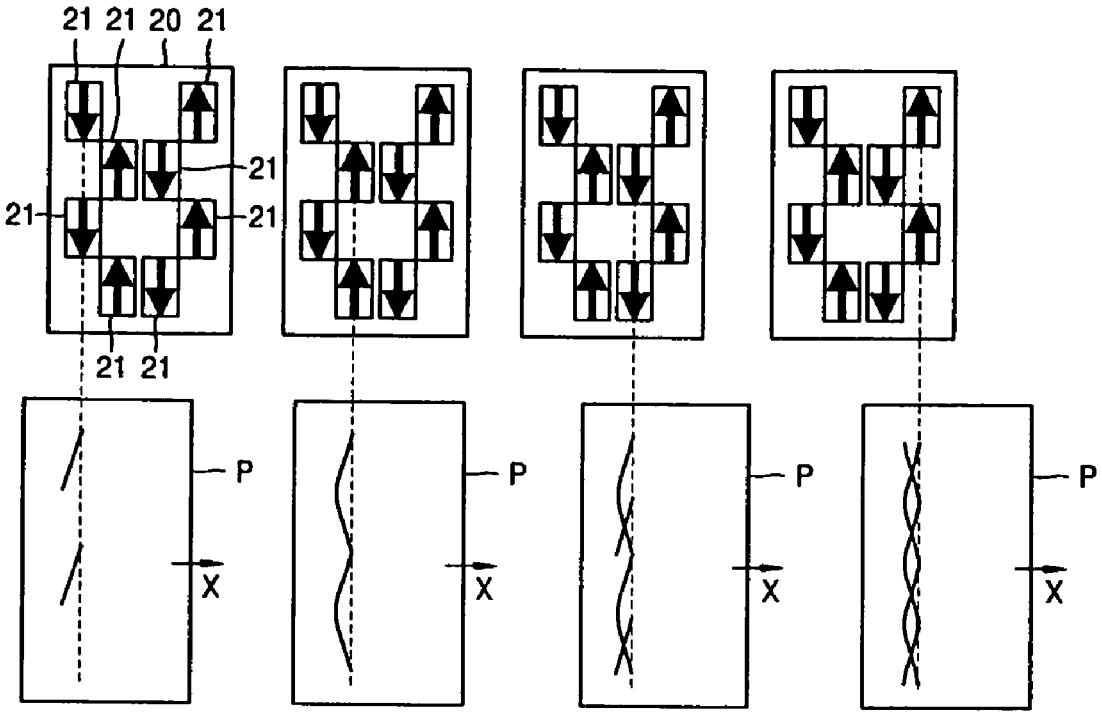
FIG. 3 (PRIOR ART)
FIG. 3 illustrates another example of ink dots deposited on another print medium using the conventional image forming apparatus.
Figure 4:
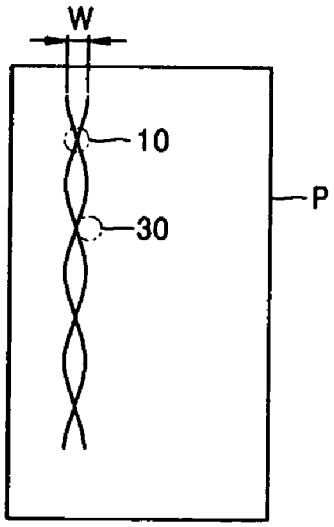
FIG. 4 (PRIOR ART)
FIG. 4 is an enlarged view of a portion of a print region of the printing medium of FIGS. 2 and 3.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 5:
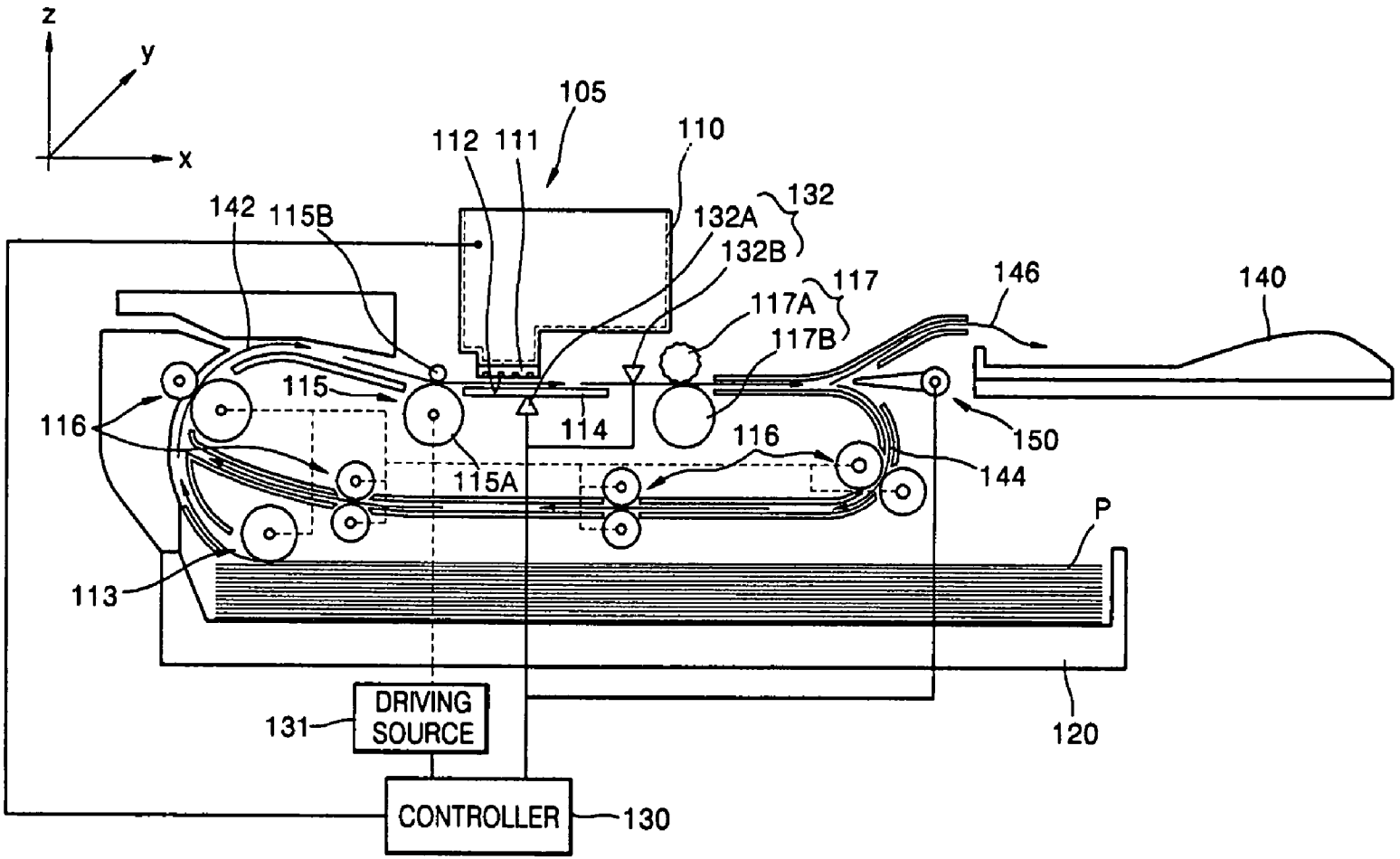
FIG. 5 is a schematic view illustrating an inkjet image forming apparatus according to an embodiment of the present general inventive concept.

FIG. 5 is a schematic view illustrating an image forming apparatus, such as a line printing type inkjet image forming apparatus, according to an embodiment of the present general inventive concept. Referring to FIG. 5, the line printing type inkjet image forming apparatus includes a paper feeding cassette 120, a printhead unit 105, a support member 114 that faces the printhead unit 105, a sensing unit 132 to detect whether a defective nozzle exists in a nozzle unit 112, a plurality of print medium-feeding units 113, 115, 116, and 117 to feed a print medium P, a path conversion guide unit 150 to select a feeding path of the print medium P, and a stacking unit 140 on which a discharged print medium P is stacked. The line printing type inkjet image forming apparatus (referred to hereinafter as the inkjet image forming apparatus) further includes a controller 130 to control operations of each of above enumerated elements.

The print medium P is initially stacked on the paper feeding cassette 120. The print medium P stacked on the paper feeding cassette 120 is fed along a first feeding path 142, a second feeding path 144, or a paper discharging path 146 by the print medium-feeding units 113, 115, 116, and 117. The first feeding path 142 is a path on which the print medium P is guided to be fed to the printhead 111, the second feeding path 144 is a path on which the print medium P fed via the first feeding path 142 is returned to the first feeding path 142, and the paper discharging path 146 is a path on which the print medium P fed via the first feeding path 142 is guided to the stacking unit 140. The second feeding path 144 and the paper discharging path 146 are connected to the first feeding path 142. The path conversion guide unit 150 that guides the print medium P on the second feeding path 144 or the paper discharging path 146 is disposed in a position where the first feeding path 142, the second feeding path 144 and the paper discharging path 146 intersect. The structure and operation of the path conversion guide unit 150 is described in detail below. In the present embodiment, an x-direction corresponds to a direction in which the print medium P is picked up from the paper feeding cassette 120 and fed under the printhead 111, a y-direction is a widthwise direction of the print medium P, and a second direction that is perpendicular to the x-direction and the y-direction.

The print medium-feeding units 113, 115, 116, and 117 feed the print medium P stacked on the paper feeding cassette 120 along a predetermined path. Referring to FIG. 5, the print medium-feeding units 113, 115, 116, and 117 include a pickup roller 113, a feeding roller 115, a driving roller 116, and a paper discharging roller 117. The print medium-feeding units 113, 115, 116, and 117 are driven by a driving source 131, such as a motor, and provide a force to feed the print medium P. An operation of the driving source 131 is controlled by the controller 130 which is described below.

The pickup roller 113 is installed at one side of the paper feeding cassette 120 and picks up the print medium P that is stacked on the paper feeding cassette 120 one by one, thereby withdrawing the print medium P from the paper feeding cassette 120. The pickup roller 113 is rotated while pressing a top side of the print medium P, thereby feeding the print medium P to an outside of the paper feeding cassette 120.

The feeding roller 115 is installed at an inlet side of the printhead 111 and feeds the print medium P withdrawn by the pickup roller 113 along the first paper path 142 to the printhead 111. The feeding roller 115 includes a driving roller 115A to provide a feeding force to feed the print medium P and an idle roller 115B to elastically engage the driving roller 115A. The feeding roller 115 can align the print medium P so that ink can be ejected onto a desired portion of the print medium P, before the print medium P is fed to the printhead 111.

The driving roller 116 that feeds the print medium P along the first and second feeding paths 142 and 144 is disposed on the first feeding path 142 and the second feeding path 144. The driving roller 116 feeds the print medium P using power transmitted from the driving source 131.

The paper discharging roller 117 is installed at an outlet side of the printhead 111 and discharges the print medium P, on which a printing operation has been completed, to an outside of the inkjet image forming apparatus. The print medium P that is discharged to the outside of the inkjet image forming apparatus via the paper discharging path 146 is stacked on the stacking unit 140. The paper discharging roller 117 includes a star wheel 117A installed in the widthwise direction of the print medium P and a support roller 117B that faces the star wheel 117A and supports a rear side of the print medium P. The print medium P having a top side on which ink is deposited by the printhead 111 while passing through the nozzle unit 112 may become wet by the ink, and the print medium P may wrinkle due to the wet ink. If the wrinkling is severe, the print medium P contacts the nozzle unit 112 or a bottom surface of a printhead body 110, and undried ink is spread (i.e., smeared) on the print medium P, and an image printed thereon may be contaminated. In addition, because of the wrinkling, there is a high probability that a distance between the print medium P and the nozzle unit 112 may not be maintained. The star wheel 117A prevents the print medium P fed in a downward direction under the nozzle unit 112 from contacting the nozzle unit 112 or the bottom surface of the printhead body 110 by maintaining the distance between the print medium P and the nozzle unit 112. At least a part of the star wheel 117A is installed to protrude further downward than in the nozzle unit 112 and makes a point contact with the top side of the print medium P. According to the above structure, the star wheel 117A makes the point contact with the top side of the print medium P so that an ink image that has been ejected on the top side of the print medium P and has not been dried yet, is prevented from being contaminated. In addition, a plurality of star wheels may be installed to feed the print medium P smoothly. When the plurality of star wheels are installed to be parallel to a feeding direction of the print medium P, a plurality of support rollers that correspond to the plurality of star wheels may be provided.

In addition, when the printing operation is consecutively performed on a plurality of sheets of the print medium P, that is, the print medium P is discharged and stacked on the stacking unit 140 and then, a next print medium P is discharged on the already-discharged print medium P before ink ejected on the top side of the print medium P is dried, a rear side of the next print medium P may be contaminated. To prevent the above-described phenomenon, an additional drying device (not shown) may be further provided.

The support member 114 is disposed below the printhead 111 so that a predetermined distance between the nozzle unit 112 and the print medium P can be maintained, and supports the rear side of the print medium P. The predetermined distance between the nozzle unit 112 and the print medium P may be about 0.5-2.5 mm.

The sensing unit 132 detects whether a defective nozzle exists in the nozzle unit 112 disposed under the printhead 111. Here, the defective nozzle may be a damaged nozzle, a missing nozzle or a weak nozzle that cannot eject ink normally. That is, the defective nozzle is detected when ink is not ejected from nozzle due to a variety of causes or when a smaller amount of ink droplets than in design specifications is ejected.

The sensing unit 132 includes a first sensing unit 132A that detects whether a defective nozzle exists in the nozzle unit 112 before the printing operation starts and a second sensing unit 132B that detects whether a defective nozzle exists in the nozzle unit 112 while the printing operation is performed. The first sensing unit 132A detects whether nozzles are clogged by radiating light directly onto the nozzle unit 112, and the second sensing unit 132B detects whether a nozzle is defective in the nozzle unit 112 by radiating light onto the fed print medium P that is being printed.

The first or the second sensing unit (132A or 132B) may be an optical sensor including a light-emitting sensor (e.g., a light emitting diode) to radiate light onto the print medium P and a light-receiving sensor to receive the light reflected from the print medium P. The light-emitting sensor and the light-receiving sensor may be formed as a single unit or as separate units. The structure and operation of the optical sensor may be well-known to those skilled in the art, and thus, a detailed description thereof will not be provided.

The printhead unit 105 prints an ink image by ejecting ink onto the print medium P. The printhead unit 105 includes the printhead body 110, the printhead 111 disposed on a bottom surface of the printhead body 110, and the nozzle unit 112 disposed under the printhead 111. The feeding roller 115 is installed at the inlet side of the nozzle unit 112, and the paper discharging roller 117 is installed at the outlet side of the nozzle unit 112. In addition, a cable (not shown) transmits a driving signal generated by the controller 130 (which is described below), including power to eject ink, print data or the like, to each of nozzles of the nozzle unit 112. The cable may be a flexible cable such as a flexible printed circuit (FPC) or a flexible flat cable (FFC).

Figure 6A:
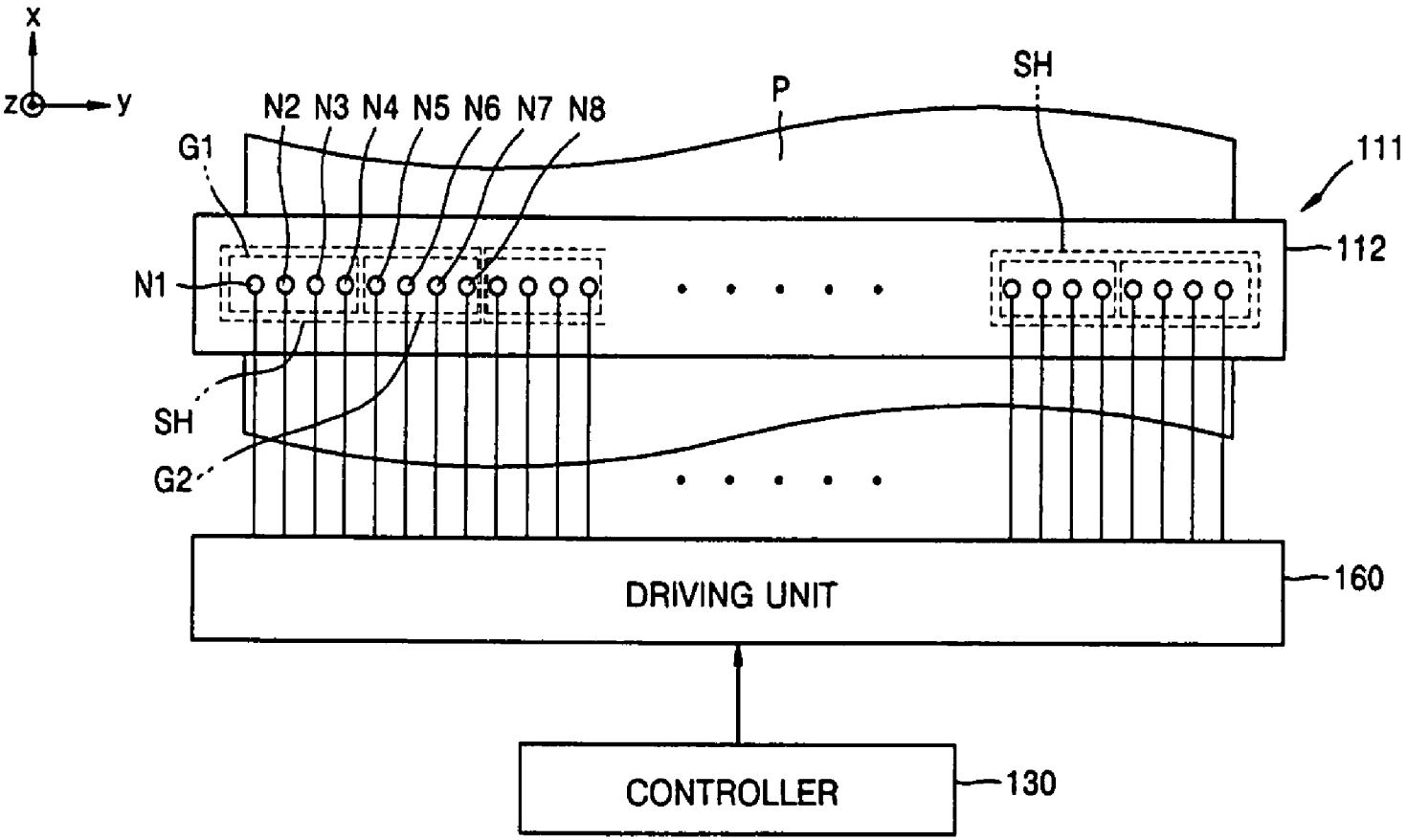
FIG. 6A illustrates a printhead according to an embodiment of the present general inventive concept.
Figure 6B:
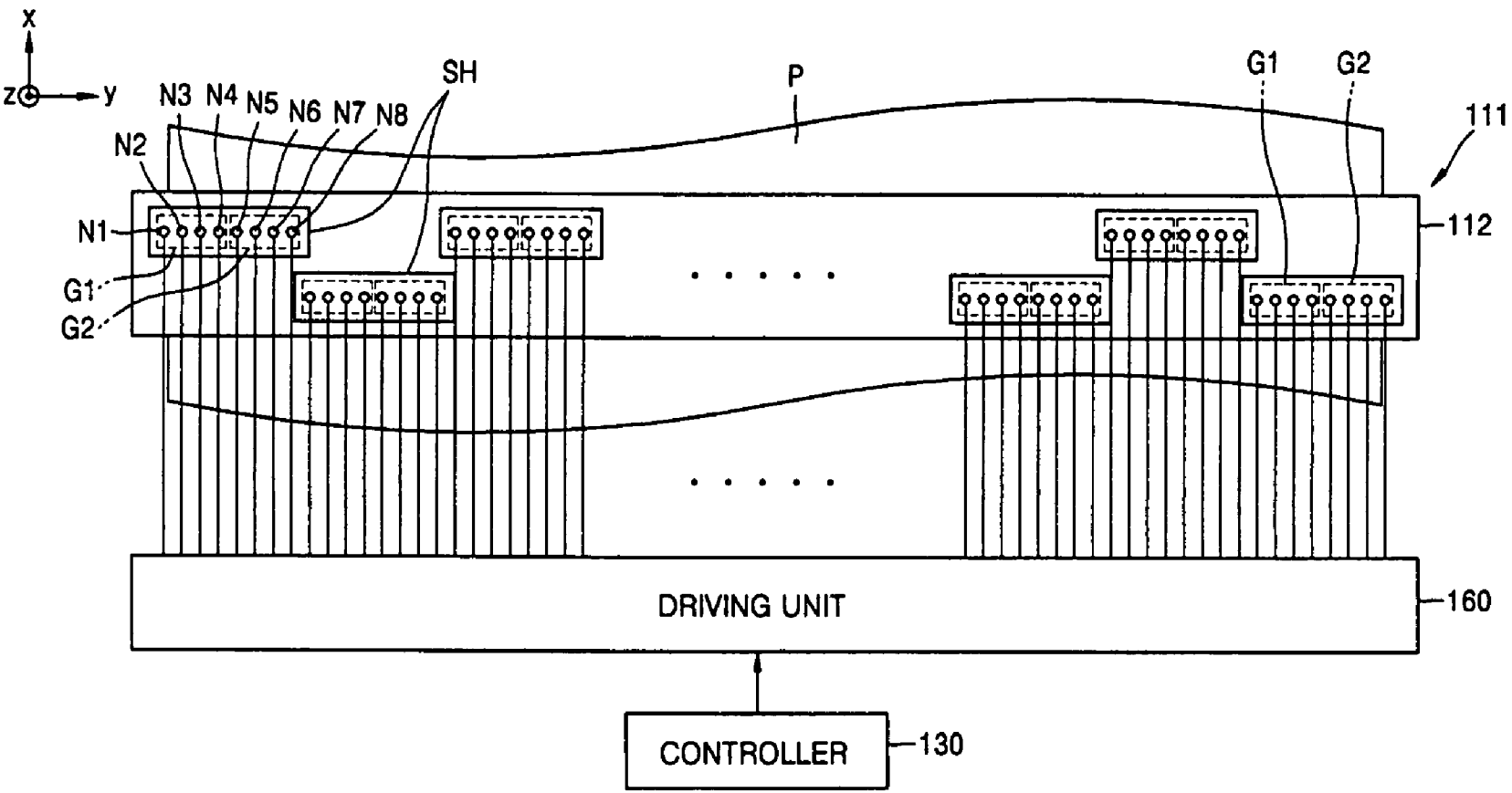
FIG. 6B illustrates a printhead according to another embodiment of the present general inventive concept.

FIG. 6A illustrates a printhead according to an embodiment of the present general inventive concept. FIG. 6B illustrates another printhead according to another embodiment of the present general inventive concept. For the convenience of explanation, like elements having same configuration and operation refer to like reference numerals. Here, reference numerals N1, N2, N3, . . . , and NN represent nozzles provided on each subhead, reference numeral SH represents a subhead (i.e., a head chip), and reference numerals G1, G2, G3, . . . , and GM represent nozzles divided into groups at each subhead.

Referring to FIGS. 5, 6A, and 6B, the printhead 111 includes the nozzle unit 112 which prints an image by ejecting ink onto the print medium P and is installed in the y-direction with respect to the x-direction which is the feeding direction of the print medium P. The printhead 111 uses thermal energy, a piezoelectric device or the like as a power source to eject the ink, and the printhead is manufactured to have a high resolution using semiconductor manufacturing processes such as etching, deposition, and sputtering, and the like. The nozzle unit 112 may be formed to have a length corresponding to a width of the print medium P or a larger length than the width of the print medium P. FIGS. 6A and 6B illustrate printheads producing one color ink. However, the present general inventive concept is not intended to be limited to printheads ejecting one color ink, and a color printhead to produce two or more colors may be used. That is, a plurality of nozzle rows to print a color image by ejecting ink of different colors may be provided in the nozzle unit 112 (see FIGS. 20A through 20C).

The nozzle unit 112 includes at least one subhead SH. A plurality of nozzles N1, N2, N3, . . . , and NN to print the ink image by ejecting ink onto the print medium P are disposed in each subhead SH. The nozzles N1, N2, N3, . . . , and NN in each subhead SH are divided into M groups G1, G2, G3, . . . , and GM so that time-division driving can be performed. That is, the nozzles N1, N2, N3, . . . , and NN and the M groups G1, G2, G3, . . . , and GM of each subhead SH are time-divisionally driven independently by a driving unit 160 that is described below. In the present embodiment, as illustrated in FIGS. 6A and 6B, eight nozzles N1, N2, N3 . . . , and N8 are disposed at each subhead SH, and each subhead SH is time-divisionally driven into two groups G1 and G2. When the nozzles of a subhead SH or a group G are driven time-divisionally, the nozzles eject ink into the paper one after the other according to a predetermined order in the subhead and corresponding nozzles of different subheads eject ink simultaneously. That is, for example, a second nozzle of a first subhead may eject ink after a first nozzle of the first subhead or may simultaneously eject when a second nozzle of a second subhead ejects ink after a first nozzle of the second subhead ejects ink. The arrangement, number of nozzles and groups described while referring to FIGS. 6A and 6B are merely illustrative, and the present general inventive concept is not intended to be limited by the described groups and number of nozzles.

Although not shown, an ink-storage space to store ink is disposed in the printhead body 110. The ink-storing space may be formed in a cartridge shape in the printhead body 110 to be attachable and detachable therefrom. The printhead body 110 may further include a chamber having the driving unit 160 in communication with each of the nozzles N1, N2, N3, . . . , and NN of the nozzle unit 112 to apply pressure to eject the ink using, for example, a piezoelectric device and a thermal driving heater, a passage, such as an orifice to supply the ink stored in the printhead body 110 to the chamber, a manifold which is a common passage to supply ink that flows in via the passage to the chamber, and a restrictor which is a separate passage to supply ink to each chamber from the manifold and/or the like. The chamber, the passage, the manifold, the restrictor and the like may be well-known to those skilled in the art, and thus, a detailed description thereof will not be provided.

The driving unit 160 supplies an ejecting force and time-divisionally drives the N nozzles N1, N2, N3 . . . , and NN of each subhead SH and the N nozzles N1, N2, N3, . . . , and NN divided into the M groups (or blocks) G1, G2, G3, . . . , and GM, thereby printing the ink image. The driving unit 160 may be classified according to a type of an actuator that supplies an ejecting force to the ink droplets. The driving unit 150 may be a thermal driving type that generates bubbles in the ink using a heater to eject the ink droplets using an expansion force of the bubbles, or a piezoelectric device type that ejects the ink droplets using pressure applied to the ink due to deformation of a piezoelectric device. As described above, the driving unit 160 independently and time-divisionally drives the N nozzles N1, N2, N3, N4, . . . , and NN and the M groups G1, G2, G3, . . . , and GM thereby printing the ink image. In this case, the ejecting operation of the nozzle unit 112, that is, the ejecting operations of the N nozzles N1, N2, N3, N4, . . . , and NN and the M groups G1, G2, G3, . . . , and GM are controlled by the controller 130 that is described below.

Figure 7:
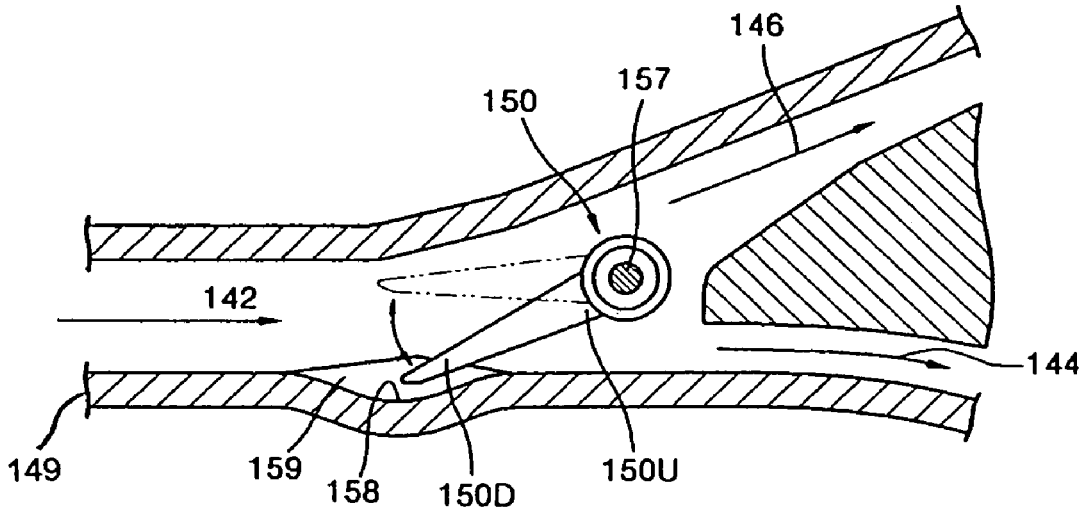
FIG. 7 is a cross-sectional view of a path conversion guide unit of the image forming apparatus of FIG. 5.
Figure 8:
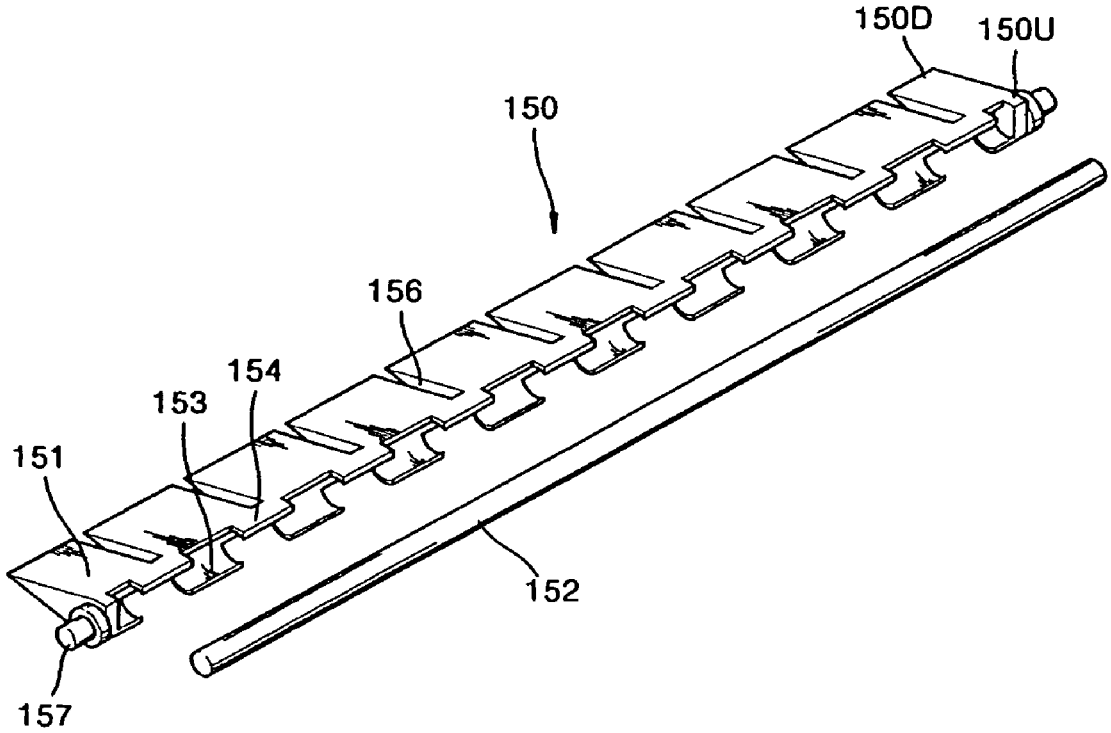
FIG. 8 is an exploded perspective view of the path conversion guide unit illustrated in FIG. 7.
Figure 9:
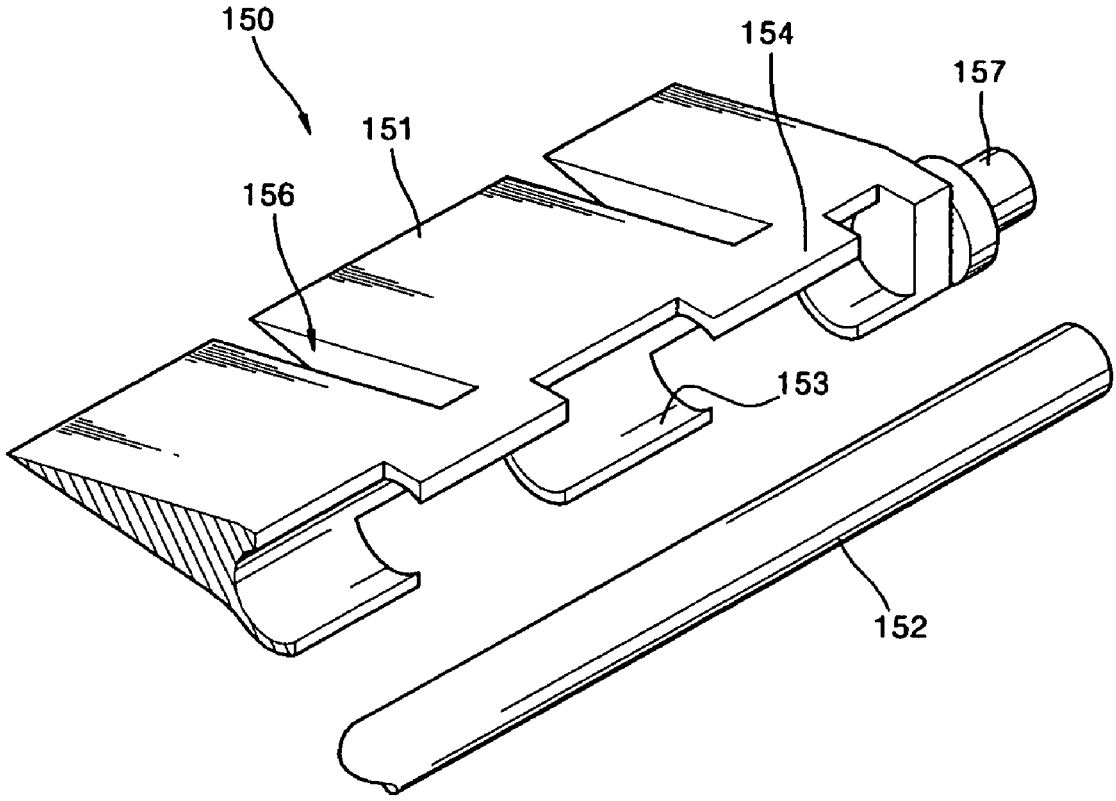
FIG. 9 is a partially-enlarged view of the path conversion guide unit of FIG. 7.
Figure 10:
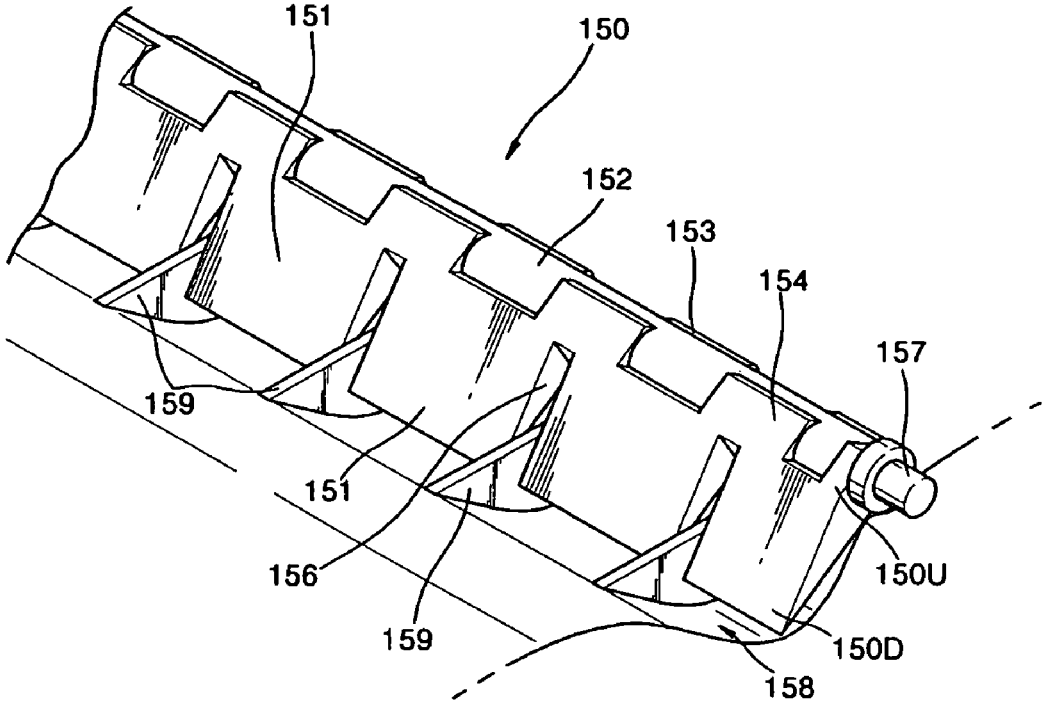
FIG. 10 illustrates the path conversion guide unit of FIG. 7.

FIG. 7 is a cross-sectional view of a path conversion guide unit of the image forming apparatus of FIG. 5, FIG. 8 is an exploded perspective view of the path conversion guide unit illustrated in FIG. 7, and FIG. 9 is an enlarged partial view of the path conversion guide unit illustrated in FIG. 7. In addition, FIG. 10 illustrates the path conversion guide unit of FIG. 7.

Referring to FIGS. 5 and 7, the path conversion guide unit 150 is disposed at a position where the first feeding path 142, the second feeding path 144 and the discharging path 146 intersect. The path conversion guide unit 150 guides the print medium P fed along the first feeding path 142 to be fed along the second feeding path 144 or to be discharged via the paper discharging path 146. The path conversion guide unit 150 is formed of resin having one long side in the x direction and an overall rectangular shape in the y direction. When the path conversion guide unit 150 is placed in a first position indicated by a solid line, the print medium P fed along the first feeding path 142 is discharged into the stacking unit 140 via the paper discharging path 146. When the path conversion guide unit 150 is placed in a second position indicated by a dotted line, the print medium P fed along the first feeding path 142 is again fed along the first feeding path 142 through the second feeding path 144. The operation of the path conversion guide unit 150 is controlled by the controller 130 is described below. Hereinafter, a sharp portion of the path conversion guide unit 150 that can be placed in the first position or in the second position to select the second feeding path 144 or the paper discharging path 146 of the print medium P is referred to as a lower-end portion 150D, and a portion of a first shaft 157 supported by a main body frame 149 is referred to as an upper-end portion 150U. A trough 158 is formed in a concave shape at a bottom surface of the main body frame 149 that contacts the lower-end portion 150D of the path conversion guide unit 150 so that the print medium P is not jammed. A guide rib 159 is disposed at the trough 158 to prevent paper jams between the lower-end portion 150D of the path conversion guide unit 150 and the trough 158.

Referring to FIG. 8, the path conversion guide unit 150 includes a guide main body 151, the first shaft 157 monolithically formed with the guide main body 151, a second shaft 152 to be inserted into the guide main body 151, and supports 153 and 154 to support the second shaft 152. The first shaft 157 protrudes from both end sides of the upper-end portion 150U of the guide main body 151. Here, the first shaft 157 may be monolithically formed with the guide main body 151. The first shaft 157 is assembled with the main body frame (not shown) inside the inkjet image forming apparatus, and can be rotated in a predetermined direction by the controller 130 to guide the print medium P on the second feeding path 144 or the discharging path 146.

A blank space is formed in the upper-end portion 150U of the guide main body 151 to insert the second shaft 152 therein. Here, the blank space is formed so that a center of the first shaft 157 and a center of the second shaft 152 coincide when the second shaft 152 is inserted into the blank space. In this case, since the second shaft 152 is located in a rotating center of the path conversion guide unit 150, the second shaft 152 remains located at the rotating center when the path conversion guide unit 150 is rotated.

The supports 153 and 154 protrude from the upper-end portion 150U of the guide main boy 151 to support the second shaft 152 to remain fixed on the guide main body 151. The supports 153 and 154 may also be monolithically formed with the guide main body 151 and may be manufactured from same material. As illustrated in FIG. 9, the supports 153 and 154 include the first support 153 and the second support 154 respectively formed at both sides of the upper-end portion 150U of the guide main body 151. A vertical distance between the first support 153 and the second support 154 may be smaller than an outer diameter of the second shaft 152. Thus, when the second shaft 152 is inserted into the upper-end portion 150U of the guide main body 151, the first and second supports 153 and 154 may be pushed apart from each other to allow the second shaft 152 to pass therethrough. However, when the second shaft 152 is completely inserted into the upper-end portion 150U of the guide main body 151, the first and second supports 153 and 154 return to their original positions due to elasticity and partially surround an outer circumference of the second shaft 152.

As illustrated in FIG. 9, the first support 153 and the second support 154 are divided into a plurality of parts at predetermined intervals along a lengthwise direction of the second shaft 152 and face each other. The first and second supports 153 and 154 may be alternately disposed in a zigzag pattern. Thus, insertion of the second shaft 152 can be easily performed and material costs can also be reduced.

As illustrated in FIG. 9, the path conversion guide unit 150 has a tapered shape towards the first feeding path 142. In addition, a plurality of narrow grooves 156 may be formed at the lower-end portion 150D of the path conversion guide unit 150 in a direction in which the print medium P is fed. The guide rib 159 (see FIG. 10) that is disposed at the trough 158 of the main body frame (see FIG. 7) is inserted into the grooves 156 when the path conversion guide unit 150 is installed in the image forming apparatus.

The second shaft 152 may be formed of a metal having rigidity with respect to deformation (i.e., rigid metal). The path conversion guide unit 150 may be bent or deformed when the lower-end portion 150D is changed from the first position to the second position. Thus, when the second shaft 152 is formed of rigid metal having resistance against bending or deformation, the operation of selecting the path of the print medium P can be more reliable performed.

Referring to FIG. 10, the trough 158 is formed in a concave shape at the bottom surface of the main body frame to contact the lower-end portion 150D of the path conversion guide unit 150 so that the print medium P is not jammed. Since there may be a gap between the lower-end portion 150D of the path conversion guide unit 150 and the bottom surface, the print medium P fed along the second feeding path 144 (see FIG. 5) may be jammed. According to the present embodiment, to solve this problem, a plurality of guide ribs 159 are formed in the trough 158 to be parallel to the feeding direction of the print medium P. When the path conversion guide unit 150 is installed in the image forming apparatus, the guide ribs 159 are inserted into the grooves 156 formed at the lower-end portion 150D of the path conversion guide unit 150. Thus, the plurality of guide ribs 159 prevents jamming of the print medium P between the lower-end portion 150D of the path conversion guide unit 150 and the trough 158.

Figure 11:
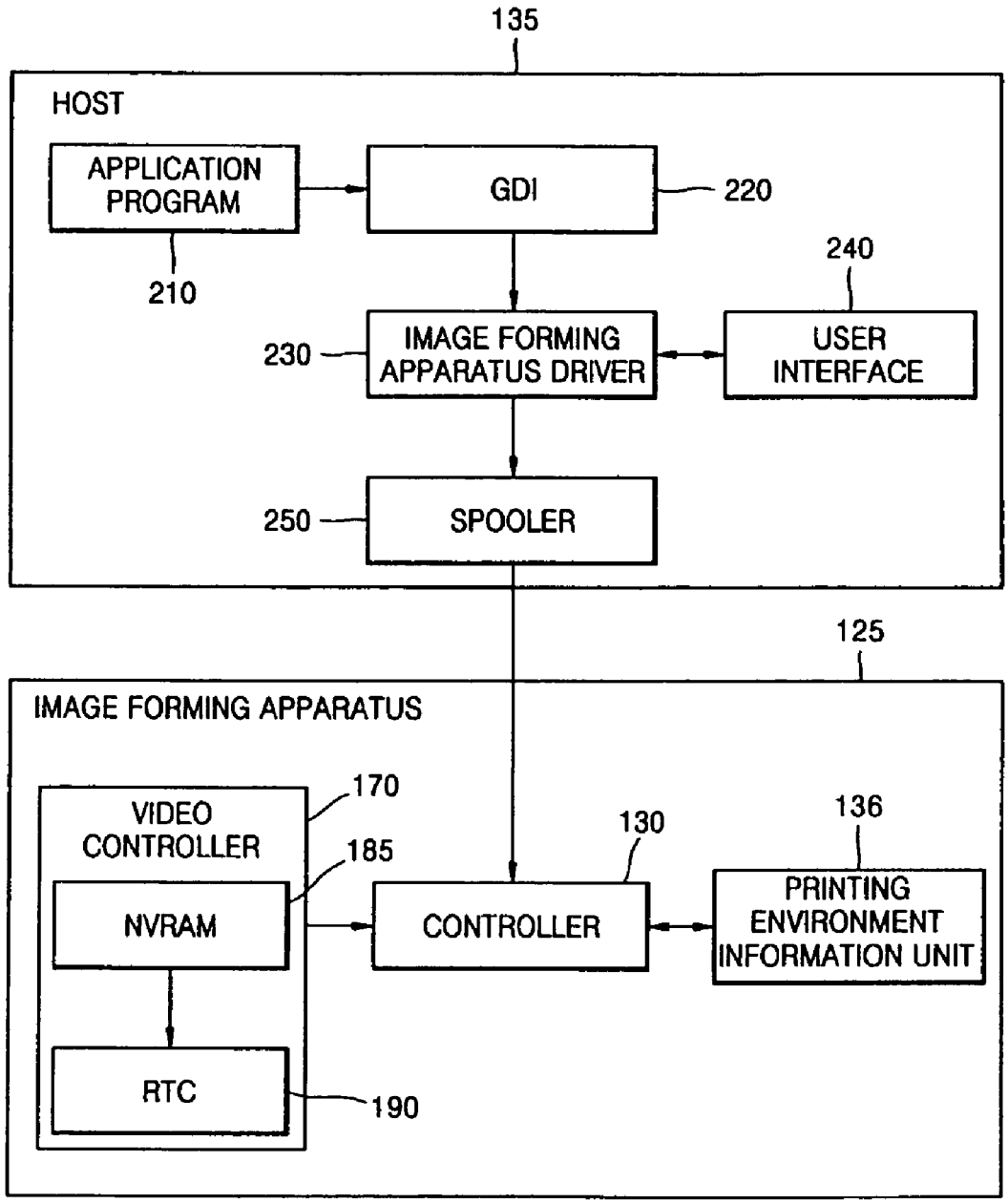
FIG. 11 is a block diagram illustrating an image forming system according to an embodiment of the present general inventive concept.
Figure 12:
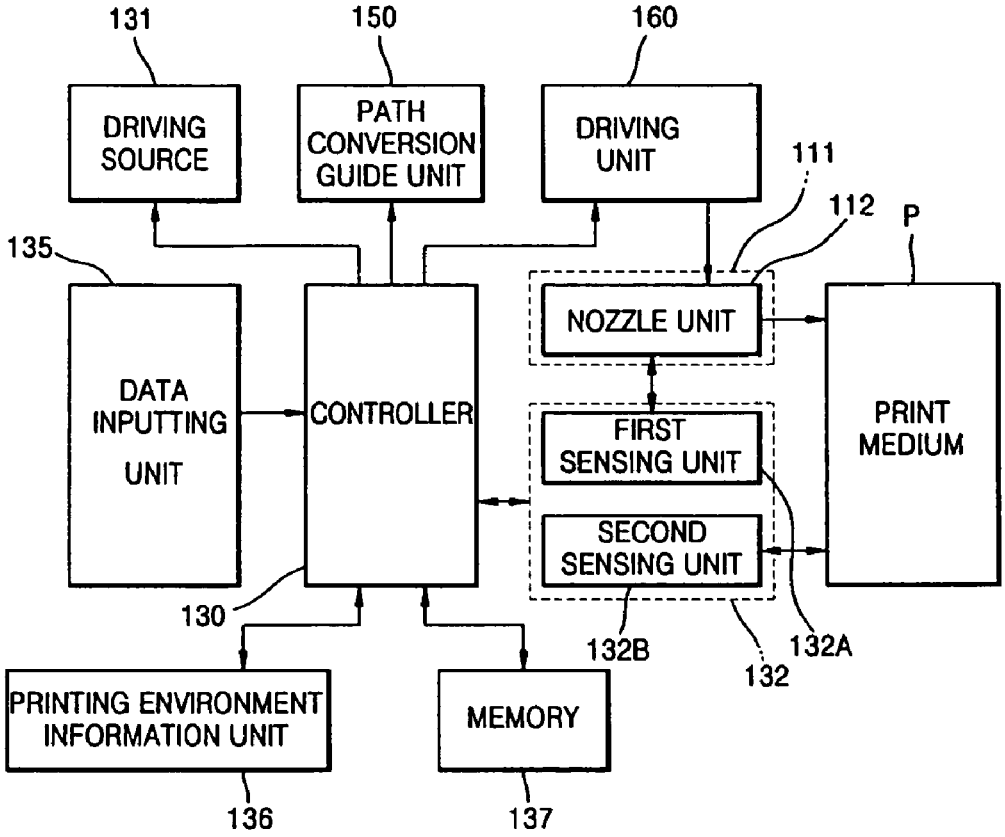
FIG. 12 is a block diagram illustrating an image forming apparatus of the image forming system of FIG. 11.

FIG. 11 is a block diagram illustrating an image forming system according to an embodiment of the present general inventive concept, and FIG. 12 is a block diagram illustrating an inkjet image forming apparatus of the image forming system of FIG. 11. Here, the image forming system includes a data input unit 135 and an image forming apparatus 125, such as an inkjet image forming apparatus.

Referring to FIG. 11, the data input unit 135 is a host system, such as a personal computer (PC), a digital camera or a personal digital assistant (PDA). Image data to be printed is input to the data input unit 135 according to an order of pages to be printed. The data input unit 135 includes an application program 210, a graphics device interface (GDI) 220, an image forming apparatus driver 230, a user interface 240, and a spooler 250. The application program 210 generates and edits an object (e.g., an image) that can be output using the image forming apparatus 125. The GDI 220 is a program included in an operating system (OS) of the host system. The GDI 220 transmits the object generated by the application program 210 to the image forming apparatus driver 230 and generates commands related to the object required by the image forming apparatus driver 230.

The image forming apparatus driver 230 is a program that generates commands that can be interpreted by the image forming apparatus 125. The user interface 240 allows a user to input parameters of a printing environment to the image forming apparatus driver 230, which parameters are used when the image forming apparatus driver 230 generates the commands that can be interpreted by the image forming apparatus 125. The spooler 250 is a program included in the OS of the host system. The spooler 250 transmits the commands generated by the image forming apparatus driver 230 to a physical input and output unit (not shown) connected to the image forming apparatus 125.

The image forming apparatus 125 includes a video controller 170, a controller 130, and a printing environment information unit 136. In addition, the video controller 170 includes a nonvolatile random access memory (NVRAM) 185 and a real time clock (RTC) 190.

The video controller 170 interprets and generates a bitmap of the commands received from the image forming apparatus driver 230 and then transmits the commands to the controller 130. The controller 130 transmits the bitmap generated by the video controller 170 to each element of the image forming apparatus 125, thereby forming an image on the print medium P. A printing operation is performed in the image forming apparatus 125 using the above-described procedure.

Referring to FIG. 12, the controller 130 may be disposed on a motherboard of the inkjet image forming apparatus 125 and controls an ejecting operation of the nozzle unit 112 disposed under the printhead 111, an operation of the print medium-feeding units 113, 115, 116, and 117 (see FIG. 5). That is, the controller 130 synchronizes operations of elements of the image forming apparatus so that ink ejected from the nozzle units 112 can be deposited on a predetermined portion of the print medium P. The controller 130 stores the image data input through the data input unit 135 in a memory 137 and checks whether the image data to be printed has been completely stored in the memory 137.

Printing environment information corresponding to each printing environment is stored in a printing environment information unit 136 when the image data input from the application program 210 is printed according to a predetermined printing environment. That is, the printing environment information corresponding to each printing environment input from the user interface 240 is stored in the printing environment information unit 136. Here, the printing environment information includes at least one of a printing density, a resolution, a size of a print medium, a type of a printing medium, a temperature, a humidity, and whether printing operations should be performed in a continuous printing manner. The controller 130 controls operations of the printhead 111, the path conversion guide unit 150, and the print medium-feeding units 113, 115, 116, and 117 according to the printing environment information stored in the printing environment information unit 136 corresponding to the input printing environment.

If the image data has been completely stored, the controller 130 operates the driving source 131 by generating a control signal corresponding to the input printing environment. The print medium P is fed by the print medium-feeding units 113, 115, 116, and 117 driven by the driving source 131 (see FIG. 5). The controller 130 operates the driving unit 160 so that ink is ejected when the print medium P fed along the first feeding path 142 enters under the nozzle unit 112.

The controller 130 generates and outputs control signals for time-divisionally driving the nozzle unit 112, and the driving unit 160 time-divisionally drives each subhead SH and M groups G1, G2, . . . , and GM in response to the control signals. In this case, the controller 130 performs printing according to the printing environment information stored in the printing environment information unit 136. That is, the controller 130 controls the driving unit 160 according to the printing environment information stored in the printing environment information unit 136 and time-divisionally drives the plurality of N nozzles N1, N2, N3, . . . , and NN of each subhead SH and the M groups G1, G2, . . . , and GM. In this case, the controller 130 time-divisionally drives the nozzles of each subhead SH and the nozzles of the M groups G1, G2, . . . , and GM in the same direction. In addition, the controller 130 controls the operation of the path conversion guide unit 150 so that the print medium P is fed multiple times under the printhead 111 and printed according to the printing environment.

In order to minimize a deviation degree generated by time-division driving and prevent a printed area printed by one nozzle from overlapping with a printed area printed by an adjacent nozzle, the controller 130 generates control signals to determine an order of driving nozzles N1, N2, N3, . . . , and NN of each subhead SH and nozzles of the M groups G1, G2, . . . , and GM so that patterns printed (ink dots) by time-divisionally driving the nozzles of each subhead SH and patterns printed (ink dots) by time-divisionally driving the nozzles of the M groups G1, G2, . . . , and GM form slanted lines having same slope with respect to the x-direction that is the feeding direction of the print medium P. In this case, the controller 130 may generate the control signals so that the patterns printed (ink dots) by driving the nozzles of the M groups G1, G2, . . . , and GM are symmetrical with one another based on the patterns printed (ink dots) by driving the nozzles of each subhead SH.

The patterns printed (ink dots) when printing is performed with a higher resolution than an actual resolution are described below with reference to the accompanying drawings in order to illustrate various embodiments of the present general inventive concept.

Figure 13:
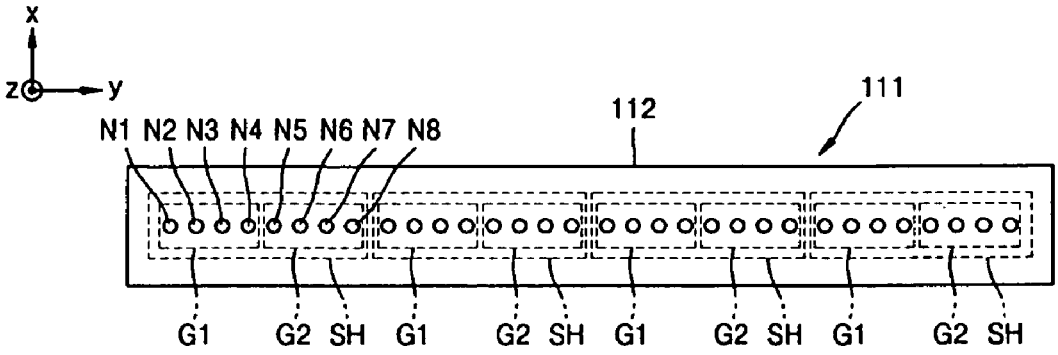
FIG. 13 illustrates a print medium and the printhead of FIG. 6A.
Figure 14A:
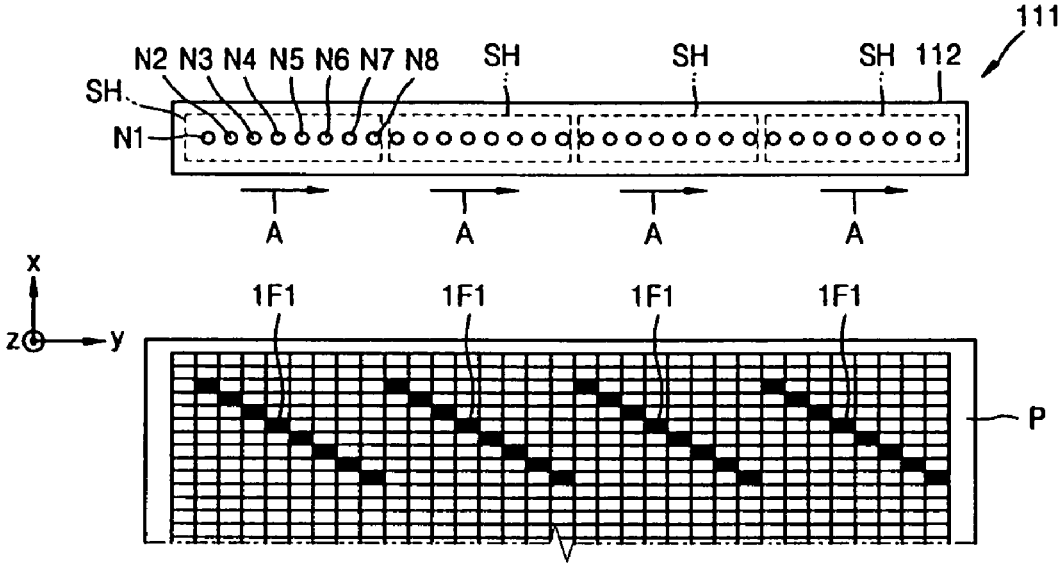
FIG. 14A illustrates patterns printed when the printhead illustrated in FIG. 13 performs a first printing operation in one direction.
Figure 14B:
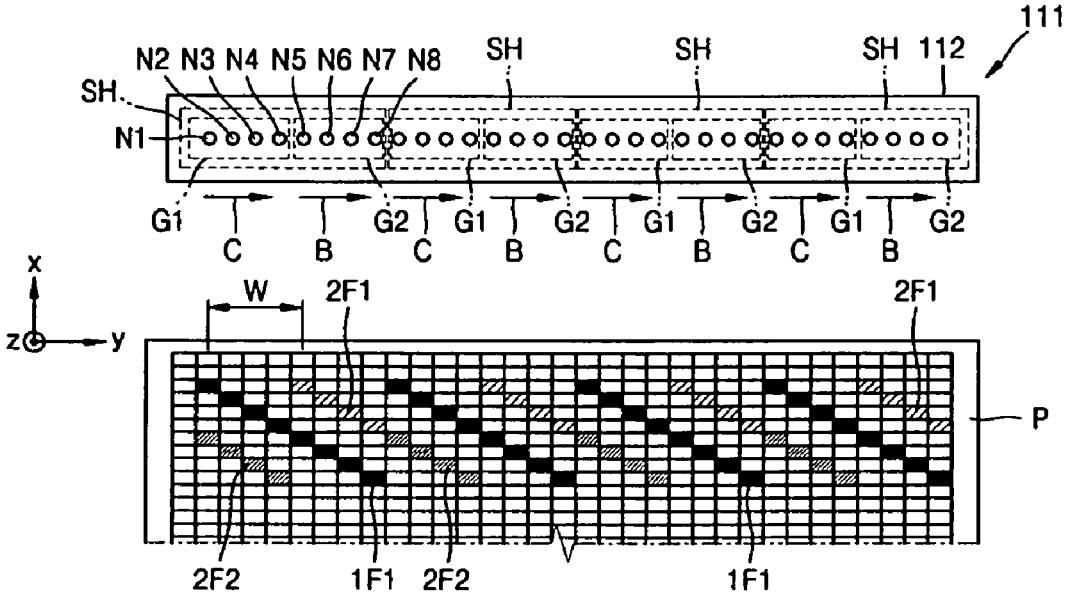
FIG. 14B illustrates patterns printed when the printhead performs a second scanning operation after the first printing operation illustrated in FIG. 14A.

FIG. 13 illustrates the print medium P and the printhead of FIG. 6A, FIG. 14A illustrates patterns printed (ink dots) when the printhead 111 illustrated in FIG. 13 performs a first printing operation, and FIG. 14B illustrates print patterns printed (ink dots) when the printhead 111 performs a second printing operation after the first printing operation illustrated in FIG. 14A. In addition, FIG. 15A illustrates print patterns printed (ink dots) when the printhead 111 of FIG. 9 performs a first printing operation in another direction, and FIG. 15B illustrates print patterns printed (ink dots) when the printhead performs a second printing operation after the first printing operation illustrated in FIG. 15A.

The printhead illustrated in FIG. 13 can be accommodated in the inkjet image forming apparatus of FIG. 5. Referring to FIGS. 5 and 13, the nozzle unit 112 includes four subheads SH. Each subhead SH includes 8 nozzles N1, N2, N3, . . . , and N8, and the 8 nozzles are time-divisionally driven and divided into a first group G1 and a second group G2. The first group G1 includes a first nozzle N1 to a fourth nozzle N4, and the second group G2 includes a fifth nozzle N5 to an eighth nozzle N8. Although FIG. 13 illustrates that the nozzle unit 112 has four subheads SH, each subhead SH including eight nozzles divided into two groups G1 and G2, it should be understood that the nozzle unit 112 may have a variety of other arrangements including any number of nozzle groups, subheads and/or nozzles. In addition, the print medium P is fed in an x-direction and printed at least two times. That is, the print medium P is again fed along the first feeding path 142 via the second feeding path 144 after the first printing operation is performed.

According to an embodiment of the present general inventive concept, when the first printing operation is performed time-divisionally, the controller 130 drives the first nozzle N1 to the eighth nozzle N8 of the four subheads SH sequentially in an order indicated by a direction of an arrow A, as illustrated in FIG. 14A. In this case, since the print medium P is fed in the x-direction, ink dots 1F1 ejected on the print medium P form one or more first slanted lines having a first slope with respect to the x-direction that is the feeding direction of the print medium P. If the first printing operation has been completed, the print medium P is again fed along the first feeding path 142 via the second feeding path 144. When the second printing operation is performed, the controller 130 time-divisionally drives the M groups, that is, two groups G1 and G2, as illustrated in FIG. 14B. In this case, the controller 130 may time-divisionally drive two groups G1 and G2 so that the patterns printed (ink dots) 2F1 and 2F2 by time-divisionally driving of the two groups G1 and G2 form one or more second slanted lines having also the first slope. That is, the second slanted lines have the same slope as the first slanted lines printed during the first printing operation. For example, the controller 130 time-divisionally drives the fifth nozzle N5 to the eighth nozzle N8 of the second group G2 in an order indicated by a direction of an arrow B to print the ink dots 2F1 and then time-divisionally drives the first nozzle N1 to the fourth nozzle N4 of the first group G1 in an order indicated by a direction of an arrow C to print the ink dots 2F2. The ink dots 2F1 ejected on the print medium P by nozzles of the second group G2 during the second printing operation and the ink dots 2F2 ejected on the print medium P by nozzles of the first group G1 form the second slanted lines having the first slope. If each subhead SH and the two groups G1 and G2 are time-divisionally driven using the above-described method, a deviation degree W generated by the time-divisionally driving can be visually minimized and the ink dots ejected by adjacent nozzles can be prevented from overlapping so that an optical density is uniform. The printing density in x- and y-directions, that is, the resolution can be improved, as illustrated in FIG. 14B, and the resolution in the feeding direction of the print medium P can be improved without reducing the feeding speed of the print medium P.

Figure 15A:
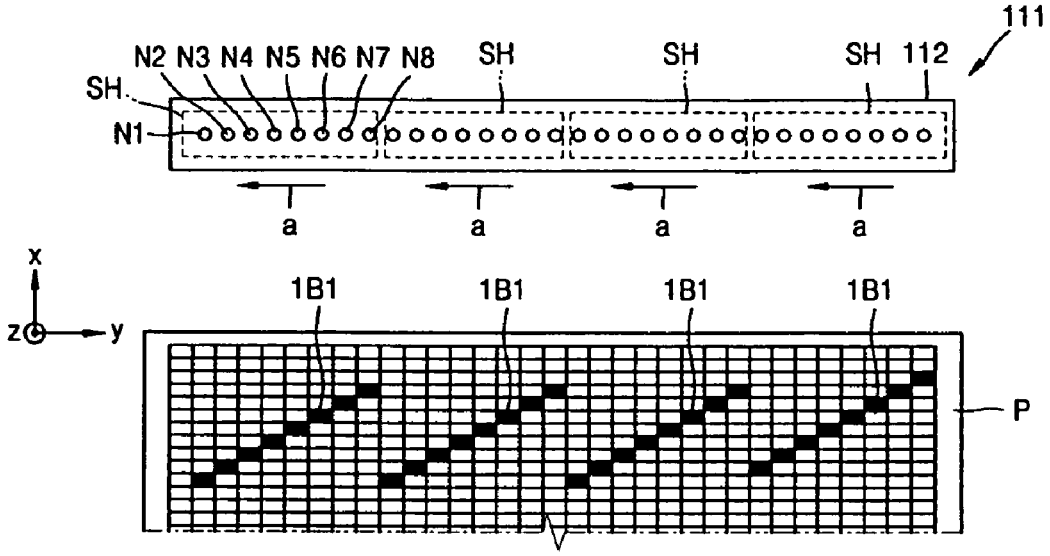
FIG. 15A illustrates patterns printed when the printhead illustrated in FIG. 9 performs a first printing operation in another direction.
Figure 15B:
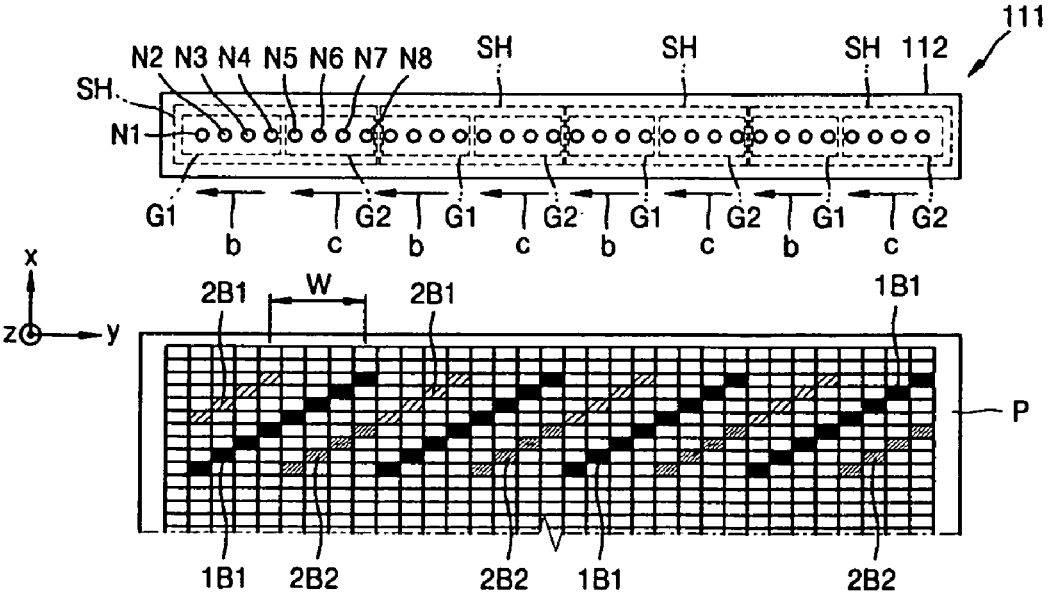
FIG. 15B illustrates patterns printed when the printhead illustrated in FIG. 9 performs a second printing operation after the first printing operation illustrated in FIG. 15A.

According to another embodiment of the present general inventive concept, when the first printing operation is performed, the controller 130 time-divisionally drives the eighth nozzle N8 to the first nozzle N1 of the four subheads SH in an order indicated by a direction of an arrow 'a', as illustrated in FIG. 15A. In this case, since the print medium P is fed in the x-direction, ink dots 1B1 ejected on the print medium P form third slanted lines having a second slope with respect to the x-direction that is the feeding direction of the print medium P. If the first printing operation has been completed, the print medium P is again fed along the first feeding path 142 via the second feeding path 144. When the second printing operation is performed, the controller 130 time-divisionally drives the M groups, that is, two groups G1 and G2, as illustrated in FIG. 15B. In this case, the controller 130 may time-divisionally drive the two groups G1 and G2 so that patterns printed (ink dots) 2B1 and 2B2 by time-divisionally driving of the two groups G1 and G2 form fourth slanted lines having also the second slope. That is, the fourth slanted lines have the second slope same as that of the third slanted lines printed during the first printing operation. For example, the controller 130 time-divisionally drives the fourth nozzle N4 to the first nozzle N1 of the first group G1 in an order indicated by a direction of an arrow 'b' and then time-divisionally drives the eighth nozzle N8 to the fifth nozzle N5 of the second group G2 in an order indicated by a direction of an arrow 'c'. The ink dots 2B1 ejected on the print medium P by the first group G1 during the second printing operation and the ink dots 2B2 ejected on the print medium P by the second group G2 form the fourth slanted lines having the second slope. If nozzles of each subhead SH and the two groups G1 and G2 are time-divisionally driven using the above-described method, a deviation degree W generated by the time-divisionally driving can be visually minimized and the ink dots ejected by adjacent nozzles can be prevented from overlapping so that the optical density is uniform. The printing density in x- and y-directions, that is, the resolution can be improved, as illustrated in FIG. 15B, and the resolution in the feeding direction of the print medium P can be improved without reducing the feeding speed of the print medium P.

According to the above-described embodiments, if higher resolution than an actual resolution of the printhead 111 is input from the user interface 240, the print medium P is fed multiple times under the printhead 111 for printing operations that are performed to achieve the higher resolution. That is, the controller 130 controls the operations of the path conversion guide unit 150 and the print medium-feeding units 113, 115, 116, and 117 so that the print medium P fed via the first feeding path 142 is again fed along the first feeding path 142 via the second feeding path 144. That is, in order to perform printing with the higher resolution, the controller 130 controls the operations of the path conversion guide unit 150 and the driving unit 160 according to the printing resolution stored in the printing environment information unit 136 corresponding to a desired resolution input through the user interface 240. As the desired resolution becomes higher, the print medium P is fed multiple times under the printhead 111 and the nozzle unit 112 is time-divisionally driven into a larger number of groups whenever the print medium P is fed so that printing is performed. In this case, the controller 130 may generate the control signals for time-divisionally driving the nozzles of the M groups G1, G2 . . . , and GM in an order indicated by the same direction whenever the print medium P is fed along the second feeding path 144.

One nozzle row is arranged in the nozzle unit 112 in the above-described embodiment, but this is merely an exemplary embodiment of the present general inventive concept and it should be understood that the present general inventive concept is not limited by this embodiment. The present general inventive concept can also be applied to a nozzle unit having two or more nozzle rows. For example, when two or more nozzle rows are arranged in the nozzle unit 112, the print medium P is fed via a single path and each nozzle row is independently and time-divisionally driven so that the higher resolution can be achieved. Each nozzle row can be independently and time-divisionally driven even when the print medium P is fed multiple times under the printhead 111 to achieve the higher resolution.

An inkjet image forming apparatus that can achieve a higher resolution using a single path is be described below.

Figure 16:
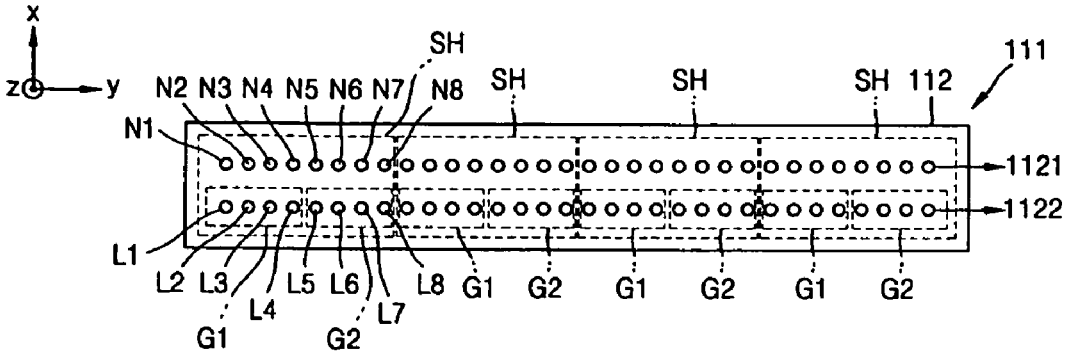
FIG. 16 illustrates a printhead according to another embodiment of the present general inventive concept.

FIG. 16 illustrates a printhead according to another embodiment of the present general inventive concept. In FIG. 16, reference numeral 1121 represents a first nozzle row, reference numeral 1122 represents a second nozzle row, reference numeral SH represents a subhead, reference numerals N1, N2 . . . , and N8 represent nozzles arranged in the first nozzle row 1121, reference numerals L1, L2, . . . , and L8 represent nozzles arranged in the second nozzle row 1122, and reference numerals G1 and G2 represent nozzles division-driven in units of group in the second nozzle row 1122. The structure and operation of the present embodiment are similar to those shown in FIGS. 14A through 15B, and thus, only a difference therebetween is described. In addition, for the convenience of explanation, like reference numerals are used in elements having the same functions as those of FIGS. 14A through 15B. The structure and operation of the first nozzle row 1121 and the second nozzle row 1122 may be reversed.

Referring to FIGS. 5 and 16, the printhead 111 includes the nozzle unit 112 that prints an image by ejecting ink onto the print medium P. The nozzle unit 112 is disposed in the y-direction with respect to the x-direction which is a feeding direction of the print medium P. The nozzle unit 112 includes at least one subhead SH having the first nozzle row 1121 and the second nozzle row 1122 in which a plurality of nozzles are arranged. The nozzles N1, N2, . . . , and N8 and L1, L2, . . . , and L8 through which ink is ejected onto the print medium P to print the image, are disposed in the first nozzle row 1121 and the second nozzle row 1122, respectively. Here, the number of nozzles arranged in the first nozzle row 1121 and the number of nozzles arranged in the second nozzle row 1122 may be the same. In addition, in order to improve resolution, the nozzles arranged in the first nozzle row 1121 and the nozzles arranged in the second nozzle row 1122, respectively, may be alternately disposed in a zigzag pattern. The first nozzle row 1121 and the second nozzle row 1122 may be time-divisionally driven in a plurality of groups. In the present embodiment, the second nozzle row 1122 is time-divisionally driven into two groups G1 and G2.

The controller 130 time-divisionally drives the nozzles N1, N2, N3, . . . , and N8 arranged in the first nozzle row 1121, the nozzles L1, L2, . . . , and L8 arranged in the second nozzle row 1122 and grouped into the groups G1 and G2. In this case, an order of driving the nozzles arranged in the first and second nozzle rows 1121 and 1122 and an order of driving the nozzles of the groups G1 and G2 are indicated by arrows in the same direction.

According to an embodiment of the present general inventive concept, the controller 130 time-divisionally drives the first nozzle row 1121 in a first direction and the second nozzle row 1122 in the same first direction as the first nozzle row 1121 but according to the groups G1 and G2. In order to minimize a deviation degree generated by the time-divisionally driving and prevent overlapping ink dots of adjacent nozzles, the controller 130 may sequentially and time-divisionally drive the first nozzle N1 to the eighth nozzle N8 arranged in the first nozzle row 1121 and may simultaneously and time-divisionally drive the second nozzle row 1122 groups G1 and G2. For example, the controller 130 generates control signals to determine an order of driving the nozzles arranged in the first nozzle row 1121 and the nozzles of the groups G1 and G2 so that patterns printed (ink dots) by driving the nozzles arranged in the first nozzle row 1121 and patterns printed (ink dots) by driving the nozzles of the groups G1 and G2 form slanted lines having the same slope.

Patterns printed (ink dots) according to another embodiment of the present general inventive concept are described below with reference to the accompanying drawings.

Figure 17:
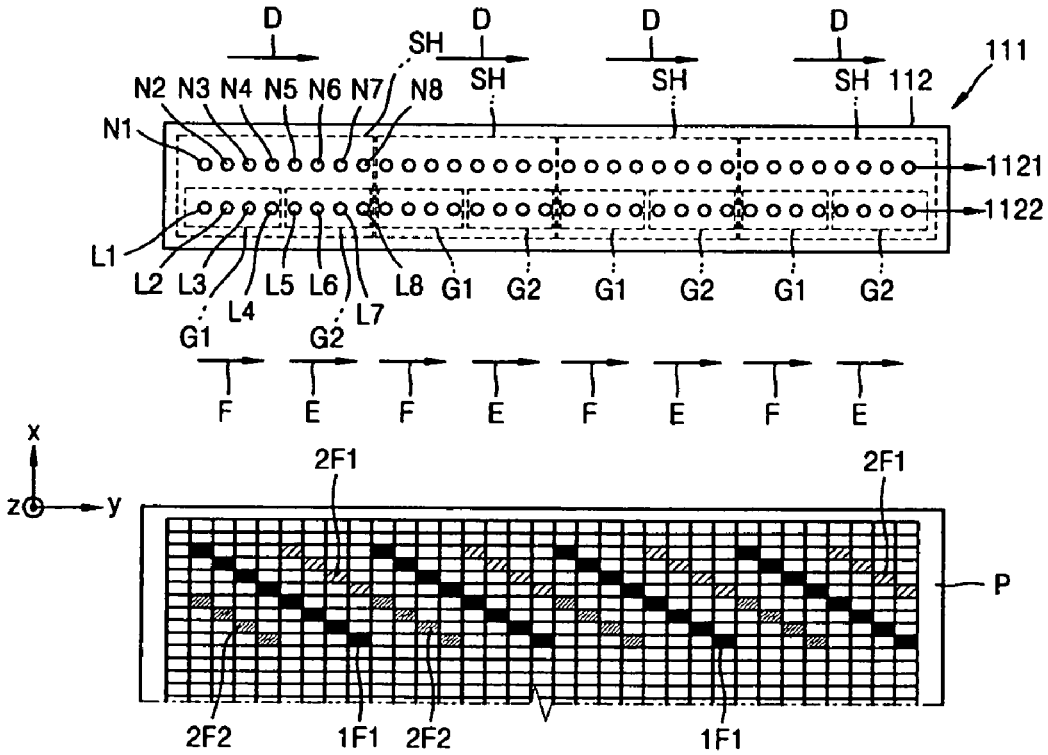
FIG. 17 illustrates patterns printed when the printhead of FIG. 16 is time-divisionally driven in one direction.
Figure 18:
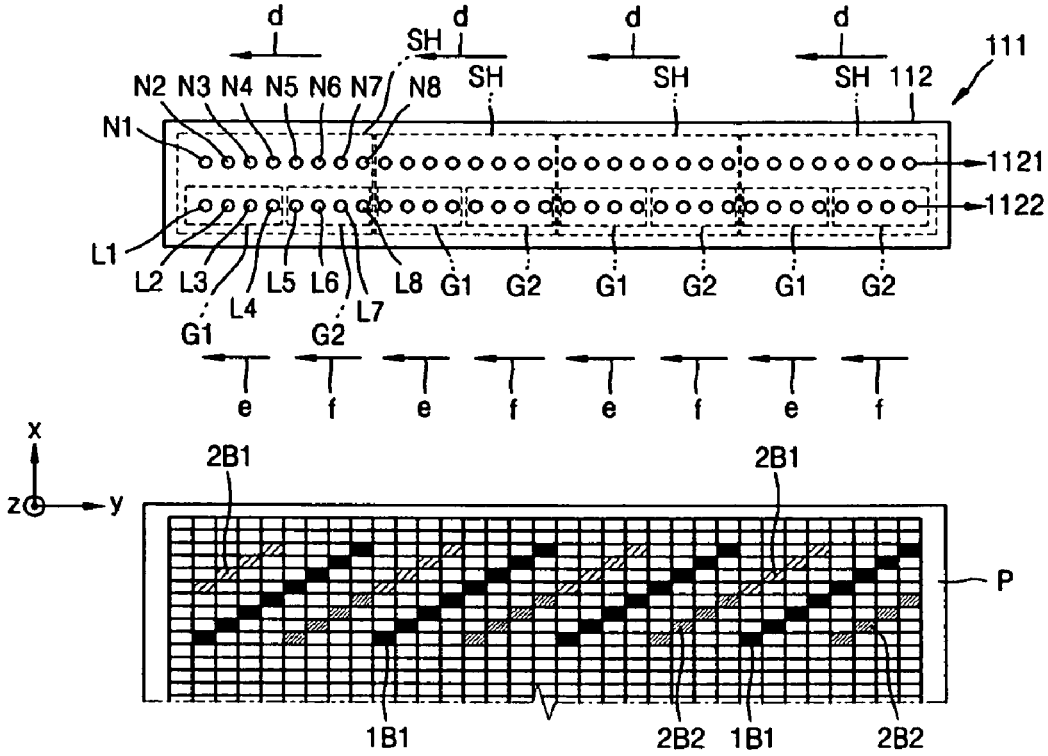
FIG. 18 illustrates patterns printed when the printhead of FIG. 16 is time-divisionally driven in another direction.

FIG. 17 illustrates patterns printed when the printhead illustrated in FIG. 16 is time-divisionally driven according to an order in one direction, and FIG. 18 illustrates patterns printed when the printhead of FIG. 16 is time-divisionally driven according to an order in an opposite direction. In FIG. 17, the printhead 111 includes four subheads SH, and each subhead SH includes first and second nozzle rows 1121 and 1122 in which 16 nozzles are arranged. In addition, the second nozzle row 1122 is time-divisionally driven into the first group G1 and the second group G2.

Referring to FIG. 17, the controller 130 drives the first nozzle row 1121 and the second nozzle row 1122 time-divisionally. That is, the controller 130 drives the first nozzle N1 to the eighth nozzle N8 of the first nozzle row 1121 time-divisionally (i.e. sequentially). Since the print medium P is fed in an x-direction, ink dots 1F1 ejected on the print medium P form first slanted lines having a first slope with respect to the x-direction that is the feeding direction of the print medium P. Simultaneously, the controller 130 drives any one of the two groups G1 and G2 of the second nozzle row 1122 and then time-divisionally drives the other group. In the present embodiment, the second group G2 is driven first and then the first group G1 is driven after the second group G2. In this case, the controller 130 may drive the two groups G1 and G2 time-divisionally so that the print pattern printed (ink dots) by time-divisionally driving the two groups G1 and G2 form second slanted lines having the first slope. That is, the second slanted lines have the same slope as the first slanted lines printed by the first nozzle row 1121. For example, the controller 130 time-divisionally drives the fifth nozzle L5 to the eighth nozzle L8 of the second group G2 in an order indicated by a direction of an arrow E and then time-divisionally drives the first nozzle L1 to the fourth nozzle L4 of the first group G1 in an order indicated by a direction of an arrow F. Thus, ink dots 2F1 ejected on the print medium P by the second group G2 and ink dots 2F2 ejected on the print medium P by the first group G1 the second slanted lines having the same slope as the first slanted lines. When the first nozzle row 1121 and the two groups G1 and G2 are time-divisionally driven using the above-described method, a deviation degree W generated by the time-division driving can be visually minimized and ink dots ejected by adjacent nozzles can be prevented from overlapping so that the optical density can be uniformly maintained. In addition, the printing density in the x- and y-directions, that is, the resolution can be improved without feeding the print medium P multiple times under the printhead, as illustrated in FIG. 17.

Referring to FIG. 18, the controller 130 drives the first nozzle row 1121 and the second nozzle row 1122 in a direction opposite to the direction of the embodiment illustrated in FIG. 17. That is, the controller 130 drives time-divisionally the eighth nozzle N8 to the first nozzle N1 of the first nozzle row 1121 in an order indicated by a direction of arrow 'd'. In this case, since the print medium P is fed in the x-direction, ink dots 1B1 ejected on the print medium P form third slanted lines having a second slope with respect to the x-direction that is the feeding direction of the print medium P. Simultaneously, the controller 130 drives time-divisionally any one of two groups G1 and G2 of the second nozzle row 1122 and then drives time-divisionally the other group. In the present embodiment, the first group G1 is driven first and then, the second group G2 is driven. In this case, the controller 130 may drive the two groups G1 and G2 time-divisionally so that the patterns printed (ink dots) by time-divisionally driving the two groups G1 and G2 form fourth slanted lines having the second slope as the third slanted lines printed by the first nozzle row 1121. For example, the controller 130 drives time-divisionally the fourth nozzle L4 to the first nozzle L1 of the first group G1 in an order indicated by a direction of arrow 'e' and then drives time-divisionally the eighth nozzle L8 to the fifth nozzle L5 of the second group G2 in an order indicated by a direction of arrow 'f'. Thus, ink dots 2B1 ejected on the print medium P by the first group G1 and ink dots 2B2 ejected on the print medium P by the second group G2 form the fourth slanted lines having the same second slope. When the first nozzle row 1121 and the two groups G1 and G2 are time-divisionally driven using the above-described method, a deviation degree W generated by the time-division driving can be visually minimized and ink dots ejected by adjacent nozzles can be prevented from overlapping so that the optical density can be uniformly maintained. In addition, the printing density in the x- and y-directions, that is, the resolution can be improved without feeding the print medium P multiple times under the printhead, as illustrated in FIG. 18.

A method of enhancing the printed image quality according to the present general inventive concept is described below.

Figure 19:
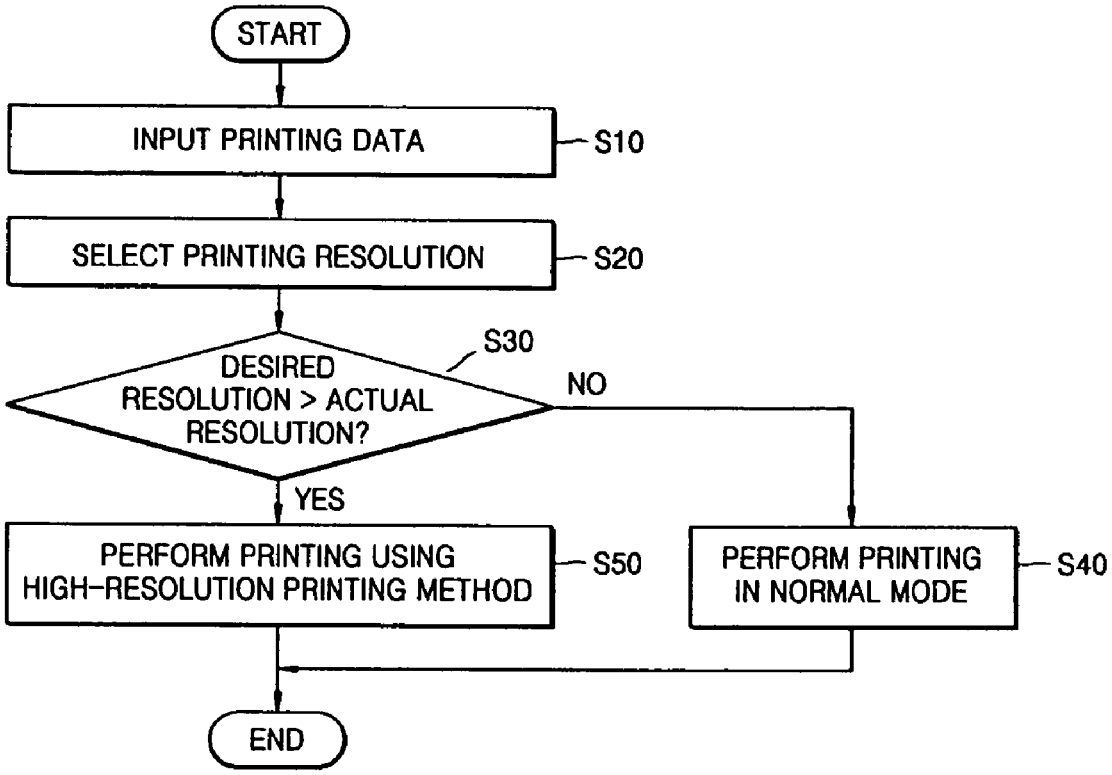
FIG. 19 is a flowchart illustrating a method of enhancing printed image quality of an inkjet image forming apparatus according to an embodiment of the present general inventive concept.

FIG. 19 is a flowchart illustrating the method of enhancing the printed image quality of an inkjet image forming apparatus according to an embodiment of the present general inventive concept. The method of FIG. 19 can be performed by the embodiments of the present general inventive concept illustrated in FIGS. 5, 11, and 16.

Referring to FIGS. 5, 11, 16, and 19, data to be printed is input from a host in operation S10. Then, a user selects a printing environment in which printing is to be performed, for example, inputs a resolution from the user interface 240 in operation S20. In this case, the input resolution and an actual resolution of the printhead 111 may be different from each other. Thus, the image forming apparatus compares the input resolution with the actual resolution of the printhead 111 in operation S30 so that a subsequent process of forming an image is performed.

When the input resolution and the actual resolution are identical to each other, the print medium P is printed in a normal mode input by default in operation S40. That is, the print medium P is fed along the first feeding path 142 and disposed along the paper discharging path 146 after the image is printed.

When the input resolution is higher than the actual resolution, the print medium P is printed using a high-resolution printing method in operation S50. The high-resolution printing method prints with higher resolution than the actual resolution and includes feeding the print medium P multiple times under the printhead 111 and time-divisionally driving the printhead 111 or time-divisionally driving the first and second nozzle rows 1121 and 1122, thereby realizing a higher resolution than the actual resolution. That is, the printing method with higher resolution is described above and thus, a detailed description thereof will not be repeated.

Figure 20A:
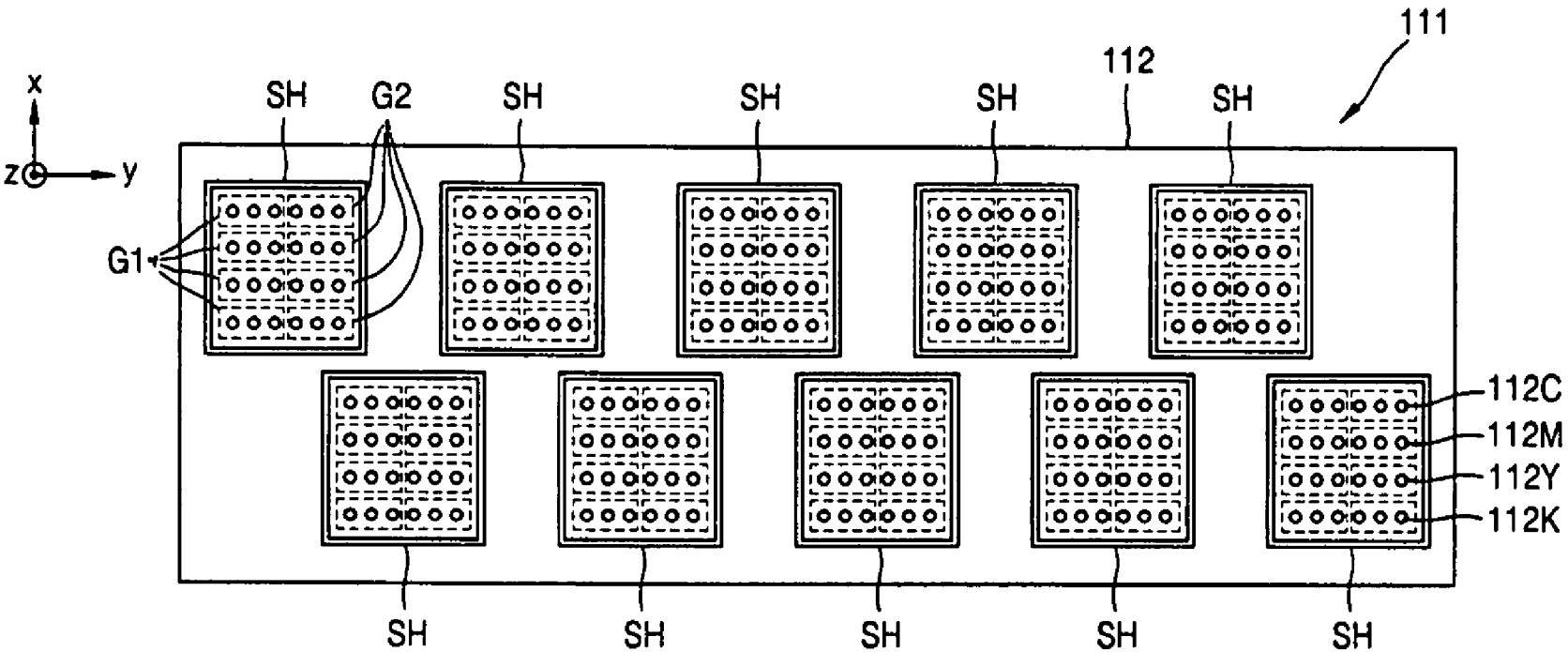
FIGS. 20A through 20C are cross-sectional views of printheads according to various embodiments of the present general inventive concept
Figure 20B:
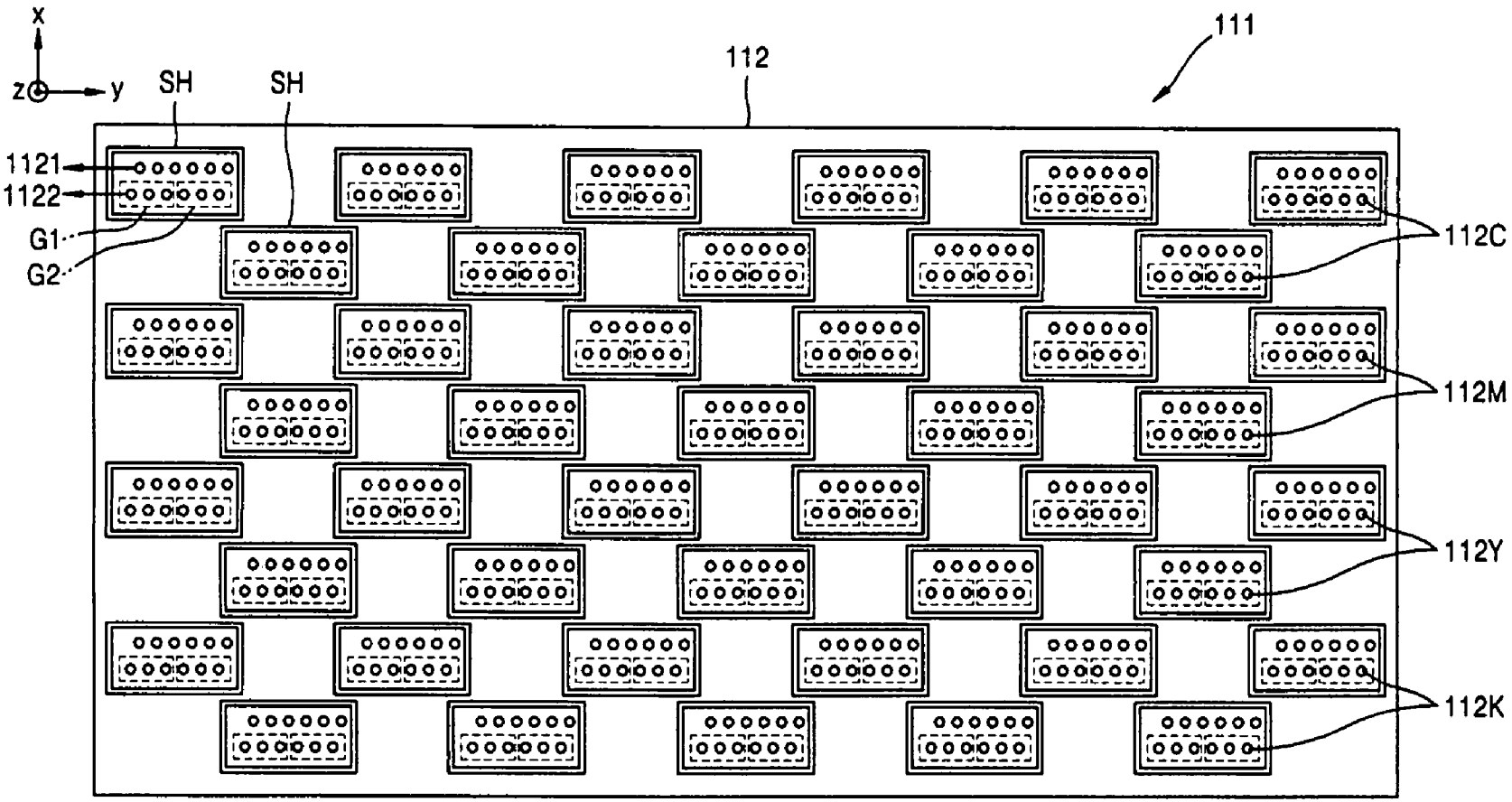
Figure 20C:
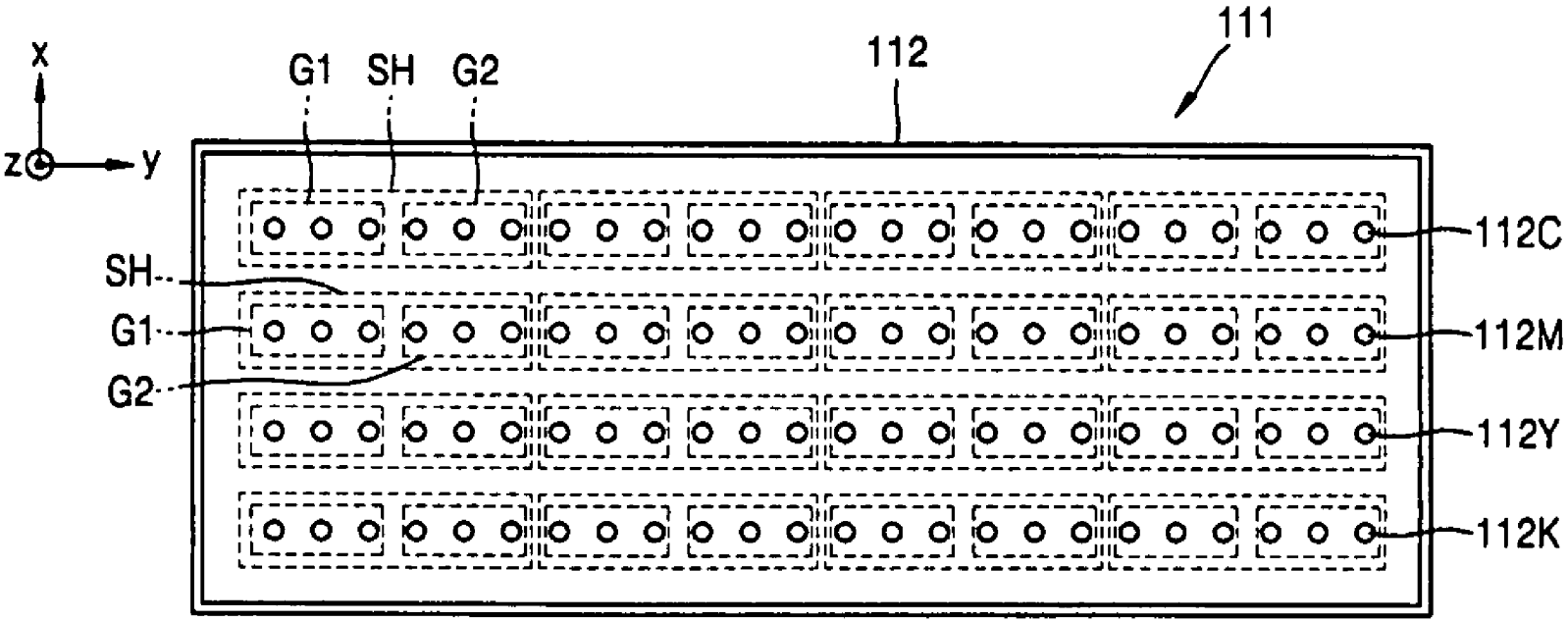

FIGS. 20A through 20C are cross-sectional views of printheads according to various embodiments of the present general inventive concept. Ten subheads SH are disposed in a y-direction in a zigzag pattern in the printhead 111 of FIG. 20A. Each subhead has four nozzle rows 112C, 112M, 112Y, and 112K ejecting cyan, magenta, yellow, and black ink, respectively. A plurality of subheads SH in which the first nozzle row 1121 and the second nozzle row 1122 are alternately disposed are disposed in the y-direction in a zigzag pattern in the printhead 111 of FIG. 20B. The subheads in each zigzag pattern 112C, 112M, 112Y, and 112K eject ink of one color, cyan, magenta, yellow, and black ink, respectively. Four subheads SH are disposed in the y-direction in rows in the printhead 111 of FIG. 20C. Here, reference numerals 112C, 112M, 112Y, and 112K denote nozzle rows which eject cyan, magenta, yellow, and black ink, respectively. The printhead 111 illustrated in FIGS. 20A through 20C are various embodiments of a printhead of a color inkjet image forming apparatus. However, the illustrated embodiments are merely illustrative and it should be understood that the present general inventive concept is not limited thereby.

The embodiments of the present general inventive concept can be embodied as computer readable codes on a computer readable recording medium. The computer readable recording medium may include any data storage device that can store data which can be thereafter read by a computer system. Examples of the computer readable recording medium include a read-only memory (ROM), a random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion. The embodiments of the present general inventive concept may also be embodied in hardware or a combination of hardware and software. For example, the controller 130 may be embodied in software, hardware, or a combination thereof.

According to various embodiments of the present general inventive concept, a printhead is time-divisionally driven in units of subheads and groups, thereby realizing a higher resolution than a nominal resolution of the printhead. In addition, a deviation degree generated by the time-division driving can be visually minimized and ink dots ejected by adjacent nozzles can be prevented from overlapping.

As described above, in the inkjet image forming apparatus according to various embodiments of the present general inventive concept, nozzles of subheads and nozzles of the subhead divided into the groups are time-divisionally driven in the same direction so that a deviation degree generated by the time-division driving can be minimized and the printed image quality can be enhanced. When a double-printed area or an unprinted area is formed according to the conventional methods, a difference in the optical density occurs in a printed image. Since the difference is visible, the printed image quality is lowered. According to various embodiment of the present general inventive concept, the subheads and the subheads divided into groups are time-divisionally driven in the same direction such that a double-printed area or an unprinted area are not formed, and ink is uniformly ejected on the print medium such that the printed image quality can be enhanced. In addition, according to various embodiments of the present general inventive concept, the subheads and the groups of the subheads are time-divisionally driven while the print medium is fed multiple times under the printhead according to a desired printing environment such that the printed image can achieve a higher resolution than the nominal resolution of the printhead. In addition, selecting a path of the print medium that has passed under the print head can be more reliable and the print medium is not held between a lower-end portion of a guide unit and a trough.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet image forming apparatus, comprising:

a printhead having one or more subheads each having one or more groups each including a plurality of nozzles and a printhead length corresponding to a width of a print medium;

a driving unit to drive the plurality of nozzles of the one or more subheads to print an image;

a first feeding path through which the print medium is guided to be fed to the printhead in a feeding direction;

a second feeding path which is connected to the first feeding path and through which the print medium on which the image has been printed is guided to be again fed along the first feeding path;

a path conversion guide unit disposed in a position where the first and second feeding paths intersect to guide the print medium to be discharged or fed along the second feeding path;

a print medium feeding unit installed on the first and second feeding paths to feed the print medium along the first and second feeding paths; and a controller to synchronize operations of the driving unit, the path conversion guide unit, and the print medium feeding unit so that ink ejected from the one or more subheads is deposited on a desired portion of the print medium, and to generate a first control signal to control the driving unit to time-divisionally drive the one or more subheads and the one or more groups, wherein the controller drives time-divisionally the plurality of nozzles of the one or more subheads and the plurality of nozzles of the one or more groups in a same direction.

2. The inkjet image forming apparatus of claim 1, further comprising:

a printing environment information unit to store information about a predetermined printing environment when image data is printed to form the image according to the predetermined printing environment, wherein the controller generates a second control signal to control the path conversion guide unit and the driving unit according to the information about the predetermined printing environment stored in the printing environment information unit.

3. The inkjet image forming apparatus of claim 2, wherein the controller generates a third control signal to determine an order of driving the plurality of nozzles of the one or more subheads and the one or more groups so that patterns printed by driving the plurality of nozzles of the one or more subheads and patterns printed by driving the plurality of nozzles of the one or more groups form slanted lines having a same slope.

4. The inkjet image forming apparatus of claim 3, wherein the controller generates a fourth control signal to drive the plurality of nozzles so that the patterns printed by driving the plurality of nozzles of the one or more groups are symmetrical with one another based on the patterns printed by driving the plurality of nozzles of the one or more subheads.

5. The inkjet image forming apparatus of claim 3, wherein the controller generates a fourth control signal so that, when the printhead performs a first printing operation, the plurality of nozzles of each of the one or more subheads are time-divisionally driven in the same direction.

6. The inkjet image forming apparatus of claim 5, wherein the controller generates a fifth control signal so that, when the print medium is fed along the second feeding path, the plurality of nozzles of the one or more groups are time-divisionally driven in the same direction.

7. The inkjet image forming apparatus of claim 1, wherein the path conversion guide unit comprises:

a guide main body;

a first shaft formed with the guide main body protruding from both end sides of an upper-end portion of the guide main body;

a second shaft inserted into the upper-end portion of the guide main body so that an axial center of the second shaft coincides with an axial center of the first shaft; and a support to support the second shaft so that the second shaft is not deviated from the guide main body, and the support being formed with the guide main body at the upper-end portion of the guide main body.

8. The inkjet image forming apparatus of claim 7, wherein the second shaft is formed of metal having rigidity with respect to deformation.

9. The inkjet image forming apparatus of claim 7, wherein the path conversion guide unit comprises:

a plurality of grooves disposed perpendicular to edges of the main body and formed at a lower-end portion of the guide main body.

10. The inkjet image forming apparatus of claim 7, wherein the support comprises:

a plurality of first supports to protrude from one side of the upper-end portion of the guide main body to partially surround an outer circumference of the second shaft; and a plurality of second supports to protrude from the other side of the upper-end portion of the guide main body.

11. The inkjet image forming apparatus of claim 1, wherein the driving unit is one of a thermal driving type driving unit and a piezoelectric device type driving unit.

12. The inkjet image forming apparatus of claim 1, wherein the one or more subheads are disposed in a zigzag pattern in a widthwise direction of the print medium.

13. An inkjet image forming apparatus comprising:

a printhead having a first nozzle row and a second nozzle row respectively including one or more subheads and a length corresponding to a width of a print medium, the one or more subheads each having one or more groups each having a plurality of nozzles arranged in the first nozzle row and the second nozzle row, respectively;

a driving unit to drive the plurality of nozzles of the one or more subheads to print an image;

a print medium feeding unit to feed the print medium along a predetermined path in a feeding direction; and a controller to synchronize operations of the driving unit and the print medium feeding unit so that ink ejected from the plurality of nozzles of the one or more subheads is deposited on a desired portion of the print medium and to generate a first control signal so that the driving unit time-divisionally drives the plurality of nozzles arranged in the first and second nozzle rows and the first and second nozzle rows, wherein the controller time-divisionally drives the first and second nozzle rows and the one or more groups in a same direction.

14. The inkjet image forming apparatus of claim 13, further comprising:

a printing environment information unit to store information about a predetermined printing environment when image data is printed according to the predetermined printing environment, wherein the controller generates a second control signal to drive the driving unit according to the information about the predetermined printing environment stored in the printing environment information unit.

15. The inkjet image forming apparatus of claim 14, wherein the controller generates a third control signal to time-divisionally drive the nozzles of the first nozzle row from a first nozzle to a last nozzle and to time-divisionally drive the nozzles of the one or more groups of the second nozzle row.

16. The inkjet image forming apparatus of claim 15, wherein the controller generates a fourth control signal to determine an order of driving the first nozzle row and the one or more groups so that patterns printed by driving the first nozzle row and patterns printed by driving the one or more groups form slanted lines having a same slope.

17. The inkjet image forming apparatus of claim 13, wherein the one or more subheads are disposed in a zigzag pattern in a widthwise direction of the print medium.

18. A method of enhancing printed image quality of an inkjet image forming apparatus, the method comprising:

inputting data to be printed from a host;

comparing an input resolution with an actual resolution of a printhead;

feeding a print medium along a first feeding path and time-divisionally driving nozzles of the printhead to print an image on the print medium;

feeding again the print medium along the first feeding path via a second feeding path if the input resolution is higher than the actual resolution; and time-divisionally driving the nozzles of the printhead divided into one or more groups to print an image on the print medium.

wherein an order for the feeding of the print medium and time-divisionally driving the nozzles of the printhead and an order of the time-divisionally driving of the nozzles the printhead divided into the one or more groups are in the same direction.

19. The method of claim 18, wherein first patterns printed by the feeding of the print medium and time-divisionally driving of the nozzles of the printhead and second patterns printed by the time-divisionally driving of the nozzles of the printhead divided into the one or more groups form slanted lines having the same slope.

20. An image forming apparatus, comprising:

a data input unit to input data to be printed from a host;

a feeding unit to feed a print medium;

a driving unit to time-divisionally drive the printhead; and a controller to compare an input resolution with an actual resolution of a printhead, to control the feeding unit to feed the print medium along a first feeding path, to control the driving unit to time-divisionally drive nozzles of the printhead to print an image on the print medium, to control the feeding unit to feed again the print medium along the first feeding path via a second feeding path if the input resolution is higher than the actual resolution, and to control the driving unit to time-divisionally drive the nozzles of the printhead divided into one or more groups to print the image on the print medium, wherein an order of time-divisionally driving the nozzles of the printhead and an order of the time-divisionally driving of the nozzles the printhead divided into the one or more groups are in a same direction.

21. An image forming apparatus comprising:

a printhead unit including a first subhead having first and second groups having a plurality of first and second nozzles, respectively, and a second subhead having third and fourth groups having a plurality of third and fourth nozzles, respectively;

a controller to control the printhead units to perform a first printing operation to sequentially eject ink from first and third nozzles in a first direction, and to control the printhead unit to perform a second printing operation to sequentially eject ink from second and fourth nozzles in the second and fourth group in the first direction such that an image is formed through the first and second printing operations; and a plurality of print medium feeding units to feed the print medium under the printhead unit, and the controller controls the plurality of print medium feeding units to feed the print medium a first time under the printhead unit to perform the first printing operation, and the controller controls the plurality of print medium feeding units to feed the print medium a second time under the printhead unit to perform the second printing operation.

22. The image forming apparatus of claim 21, wherein the first print operation creates first lines having a predetermined slope with reaped to a feeding direction of the print medium, and the second printing operation creates second lines having the predetermined slope.

23. The image forming apparatus of claim 22, wherein the controller compares an actual resolution of the print head and a resolution of the image, and controls the first and second operations according to the comparison between the actual resolution and the resolution.

24. The inkjet image forming apparatus of claim 22, wherein the first and second subheads comprise a plurality of rows of nozzles corresponding to a plurality of different color inks.

25. The image forming apparatus of claim 21, wherein the plurality of print medium feeding units pickup a print medium from a paper feeding cassette, and discharge the print medium in a stacking unit after feeding the print medium at least twice under the printhead to print the image thereon.

26. The image forming apparatus according to claim 21, wherein the plurality of print medium feeding units comprises:

a first feeding path on which the print medium is fed from the paper feeding cassette under the printhead;

a second feeding path on which the print medium is returned to the first feeding path after passing under the printhead;

a discharging path on which the print medium is discharged in the stacking unit; and a path conversion guide controlled by the controller to select whether the print medium follows the second feeding path or the discharge path after passing under the printhead along the first feeding path.

27. The inkjet image forming apparatus according to claim 26, wherein the path conversion guide comprises:

a hinge unit to allow the path conversion guide to rotate upon receiving a control signal from the controller from a first position when the print medium is guided to the discharge path to a second position when the print medium is guided to the second feeding path; and a guide main body attached to the hinge unit having shape of triangular prism tapering towards the first feeding path.

* * * * *